US012680266B2

(12) United States Patent
Kraft et al.

(10) Patent No.: US 12,680,266 B2
(45) Date of Patent: Jul. 14, 2026

(54) LASER RECEIVER HEIGHT ADJUSTMENT

(71) Applicant: Deere & Company, Moline, IL (US)

(72) Inventors: Anthony K. Kraft, Epworth, IA (US); Caitlin S. Gorge, Platteville, WI (US)

(73) Assignee: Deere & Company, Moline, IL (US)

( * ) Notice: Subject to any disclaimer, the term of this patent is extended or adjusted under 35 U.S.C. 154(b) by 504 days.

(21) Appl. No.: 18/364,121

(22) Filed: Aug. 2, 2023

(65) Prior Publication Data

US 2025/0043534 A1 Feb. 6, 2025

(51) Int. Cl.

| | |
|---|---|
| ***E02F 3/84*** | (2006.01) |
| ***E02F 9/26*** | (2006.01) |
| *E02F 3/76* | (2006.01) |

(52) U.S. Cl.

CPC ..... *E02F 3/847* (2013.01); *E02F 9/264* (2013.01); *E02F 3/7609* (2013.01)

(58) Field of Classification Search

CPC ..... E02F 3/847; E02F 9/264; E02F 3/7609; E02F 3/7645; E02F 3/765

See application file for complete search history.

(56) References Cited

U.S. PATENT DOCUMENTS

| | | | | |
|---|---|---|---|---|
| 4,355,946 | A | 10/1982 | Wykhuis et al. | |
| 4,820,041 | A | 4/1989 | Davidson et al. | |
| 5,951,612 | A | 9/1999 | Sahm | |
| 6,132,163 | A | 10/2000 | Andrews et al. | |
| 7,610,687 | B2 | 11/2009 | Stegmaier | |
| 8,412,420 | B2 | 4/2013 | Ruhter et al. | |
| 8,424,632 | B2 | 4/2013 | Ruhter et al. | |
| 8,915,308 | B2 * | 12/2014 | Joergensen | E02F 9/265 701/50 |
| 9,017,005 | B2 | 4/2015 | Martin et al. | |
| 9,227,478 | B2 | 1/2016 | Horstman | |
| 9,328,479 | B1 | 5/2016 | Rausch et al. | |
| 9,428,885 | B2 | 8/2016 | Nau | |
| 9,637,889 | B2 | 5/2017 | Elkins | |
| 9,777,460 | B2 | 10/2017 | Wuisan et al. | |
| 9,904,290 | B2 | 2/2018 | Pickett et al. | |
| 10,030,358 | B2 | 7/2018 | Wallace et al. | |
| 10,076,939 | B2 | 9/2018 | Simon et al. | |
| 10,094,654 | B2 | 10/2018 | Crozier et al. | |
| 10,428,493 | B2 | 10/2019 | Omelchenko et al. | |
| 10,443,209 | B2 | 10/2019 | Kumbhar et al. | |

(Continued)

FOREIGN PATENT DOCUMENTS

| | | | | |
|---|---|---|---|---|
| CN | 101522996 B | * | 7/2013 | E02F 9/2037 |
| CN | 216896455 U | | 7/2022 | |

(Continued)

OTHER PUBLICATIONS

CN 101522996 B (Year: 2013).*

(Continued)

*Primary Examiner* — Roy Rhee

(74) *Attorney, Agent, or Firm* — Lucian Wayne Beavers; Patterson Intellectual Property Law, PC

(57) ABSTRACT

A system and method are provided for determining a difference in height of a dozer blade relative to a vehicle frame between a reference position wherein the dozer blade engages the ground and a calibration position wherein the at least one sensor is at a desired height relative to a laser signal plane using a laser receiver automatic find mode.

20 Claims, 17 Drawing Sheets

(56) References Cited

U.S. PATENT DOCUMENTS

| | | | |
|---|---|---|---|
| 10,526,766 | B2 | 1/2020 | Hageman et al. |
| 10,634,492 | B2 | 4/2020 | Beery et al. |
| 10,704,226 | B2 | 7/2020 | Yamaguchi et al. |
| 10,883,248 | B2 | 1/2021 | Stotlar |
| 10,952,021 | B2 | 3/2021 | Kean et al. |
| 10,975,547 | B2 | 4/2021 | Mahrenholz |
| 11,053,663 | B2 | 7/2021 | Kean et al. |
| 11,124,943 | B2 | 9/2021 | Kean et al. |
| 11,378,398 | B2 | 7/2022 | Hornung et al. |
| 11,499,294 | B2 | 11/2022 | Vandegrift et al. |
| 11,549,800 | B2 | 1/2023 | Khatuntsev |
| 11,592,293 | B2 | 2/2023 | Khatuntsev |
| 2005/0194163 | A1 | 9/2005 | Wray |
| 2011/0169949 | A1 | 7/2011 | Mccain et al. |
| 2014/0064897 | A1 | 3/2014 | Montgomery |
| 2014/0343800 | A1 | 11/2014 | Nelson et al. |
| 2014/0350886 | A1 | 11/2014 | Metzler |
| 2015/0165856 | A1 | 6/2015 | Horstman |
| 2016/0230366 | A1* | 8/2016 | Hendron ..... E02F 3/7631 |
| 2016/0362870 | A1 | 12/2016 | Elkins |
| 2018/0061040 | A1 | 3/2018 | Beery et al. |
| 2020/0048863 | A1 | 2/2020 | Faivre et al. |
| 2020/0087887 | A1 | 3/2020 | Kean et al. |
| 2020/0087888 | A1 | 3/2020 | Kean et al. |
| 2020/0256997 | A1 | 8/2020 | Mccain et al. |
| 2020/0256998 | A1 | 8/2020 | Mccain et al. |
| 2021/0124026 | A1 | 4/2021 | Khatuntsev |
| 2022/0126827 | A1 | 4/2022 | Sahoo et al. |
| 2022/0195693 | A1 | 6/2022 | Kalantar et al. |
| 2022/0305923 | A1 | 9/2022 | Hagen et al. |
| 2023/0090080 | A1 | 3/2023 | Rapoport et al. |

FOREIGN PATENT DOCUMENTS

| | | | |
|---|---|---|---|
| CN | 115614627 | A | 1/2023 |
| CN | 218327117 | U | 1/2023 |
| EP | 2912232 | B1 | 9/2015 |
| EP | 2944727 | A2 | 11/2015 |

OTHER PUBLICATIONS

Exhibit "A"—photos of Commander C-4200 machine (undated but admitted to be prior art).
Farm Show Magazine, vol. 17, Issue #1, Page #33, article "Rubber Tracked Crawler Loader" (1993).
German Search Report issued in application No. 102024117046.8 dated Jan. 24, 2025, 10 pages.

* cited by examiner

LASER RECEIVER HEIGHT ADJUSTMENT

FIELD OF THE DISCLOSURE

The present disclosure relates generally to a work machine such as, for example, work machines which include a dozer blade mounted thereon.

BACKGROUND

Work vehicles of this type may for example include dozers, compact track loaders, excavator machines, motor graders, skid steer loaders, and other work vehicles which grade or otherwise modify the terrain or equivalent working environment in some way, and which may be self-propelled in nature.

To grade the terrain of a work site, a work vehicle and rotating laser may be used. The rotating laser is placed on a ground surface of the work site and is configured to emit a laser signal plane representing a desired slope. The work vehicle often includes a dozer blade operably coupled to a vehicle frame to perform a desired function, such as grading a ground surface. The work vehicle may include one or more adjustable supports coupled to the dozer blade and extending generally upward from the dozer blade. A sensor is often coupled to an upper end of each of the one or more adjustable supports. Each sensor may be configured to detect the laser signal plane emitted by the rotating laser.

Before grading the work site, each sensor must be adjusted to a desired height relative to the laser signal plane. The one or more adjustable supports may be adjusted relative to the dozer blade such that each sensor detects the laser signal plane at a desired location on the sensor. As the work vehicle grades the terrain, the orientation of the dozer blade may be adjusted to maintain the location of the sensor relative to the laser signal plane. In this way, an operator of the work vehicle can ensure the dozer blade is grading along the desired slope.

The operator of the existing work vehicle must manually adjust the supports to place the one or more sensors at the desired height. The operator first places the dozer blade in a reference position wherein the dozer blade engages the ground and is oriented in a desired grading orientation. The operator then must exit an operator cab of the work vehicle and manually adjusts the supports until the sensor is at the desired height. The operator then re-enters the operator cab and proceeds to grade the ground surface of the work area. If the dozer blade can no longer be oriented such that each sensor detects the laser signal plane at the desired location on the sensor, the operator must exit the cab and manually readjust the supports. An operator exiting the work vehicle to manually adjust the supports on the work site presents ergonomic and safety issues.

Thus, there is a need for an improved system for adjusting sensors coupled to a dozer blade on a work vehicle to a desired height relative to a laser signal plane emitted by a rotating laser.

BRIEF SUMMARY

This Brief Summary is provided to introduce a selection of concepts in a simplified form that are further described below in the Detailed Description. This Brief Summary is not intended to identify key features or essential features of the claimed subject matter, nor is it intended to be used to limit the scope of the claimed subject matter.

One aspect in accordance with the embodiments disclosed herein is a work vehicle. The work vehicle comprises a vehicle frame, a plurality of ground engaging units for supporting the vehicle frame from a ground surface, a ground-engaging dozer blade movably connected to the vehicle frame by a linkage assembly, at least one support, at least one sensor, and a controller. The linkage assembly is configured to allow the dozer blade to articulate relative to the vehicle frame. The dozer blade includes first and second ends. The at least one support has lower and upper portions and the lower portion of the at least one support is coupled to the dozer blade. The at least one sensor is configured to detect a laser signal plane emitted by a rotating laser. The at least one sensor is mounted to the upper portion of the at least one support. The controller includes a laser receiver automatic find mode configured to determine a difference in height of the dozer blade relative to the vehicle frame between a reference position wherein the dozer blade engages the ground and a calibration position wherein the at least one sensor is at a desired height relative to the laser signal plane.

In certain embodiments in accordance with this aspect, the at least one support includes first and second supports, the lower portion of the first support is coupled to the dozer blade nearer to the dozer blade first end than to the dozer blade second end, and the lower portion of the second support is coupled to the dozer blade nearer to the dozer blade second end than to the dozer blade first end. The at least one sensor includes first and second sensors, the first sensor being mounted to the upper portion of the first support, and the second sensor being mounted to the upper portion of the second support. In the laser receiver automatic find mode the controller is further configured to determine a first difference in height of the dozer blade relative to the vehicle frame between the reference position and a first calibration position wherein the first sensor is at a desired height relative to the laser signal plane, and determine a second difference in height of the dozer blade relative to the vehicle frame between the reference position and a second calibration position wherein the second sensor is at a desired height relative to the laser signal plane.

Another aspect in accordance with the embodiments disclosed herein is a method of controlling a work vehicle. The work vehicle includes a vehicle frame, a ground-engaging dozer blade having first and second ends and being moveably connected to the vehicle frame by a linkage assembly configured to allow the dozer blade to articulate relative to the vehicle frame, at least one support having upper and lower portions, the lower portion of the at least one support coupled to the dozer blade, at least one sensor configured to detect a laser signal plane emitted by a rotating laser, the at least one sensor being mounted to the upper portion of the at least one support, and a controller. The method includes steps of: orienting the work vehicle in an intended grading direction, and automatically determining with the controller a difference in height of the dozer blade relative to the vehicle frame between a reference position wherein the dozer blade engages the ground and a calibration position wherein the at least one sensor is at a desired height relative to the laser signal plane.

In certain embodiments in accordance with this aspect, the at least one support includes first and second supports, the lower portion of the first support is coupled to the dozer blade nearer to the dozer blade first end than to the dozer blade second end, and the lower portion of the second support is coupled to the dozer blade nearer to the dozer blade second end than to the dozer blade first end. The at least one sensor includes first and second sensors, the first sensor being mounted to the upper portion of the first support, and the second sensor being mounted to the upper portion of the second support. The method further comprises automatically determining with the controller a first difference in height of the dozer blade relative to the vehicle frame between the reference position and a first calibration position wherein the first sensor is at a desired height relative to the laser signal plane, and automatically determining with the controller a second difference in height of the dozer blade relative to the vehicle frame between the reference position and a second calibration position wherein the second sensor is at a desired height relative to the laser signal plane.

Numerous objects, features and advantages of the present invention will be readily apparent to those skilled in the art upon a review of following description in conjunction with the accompanying drawings.

DETAILED DESCRIPTION

Figure 1:
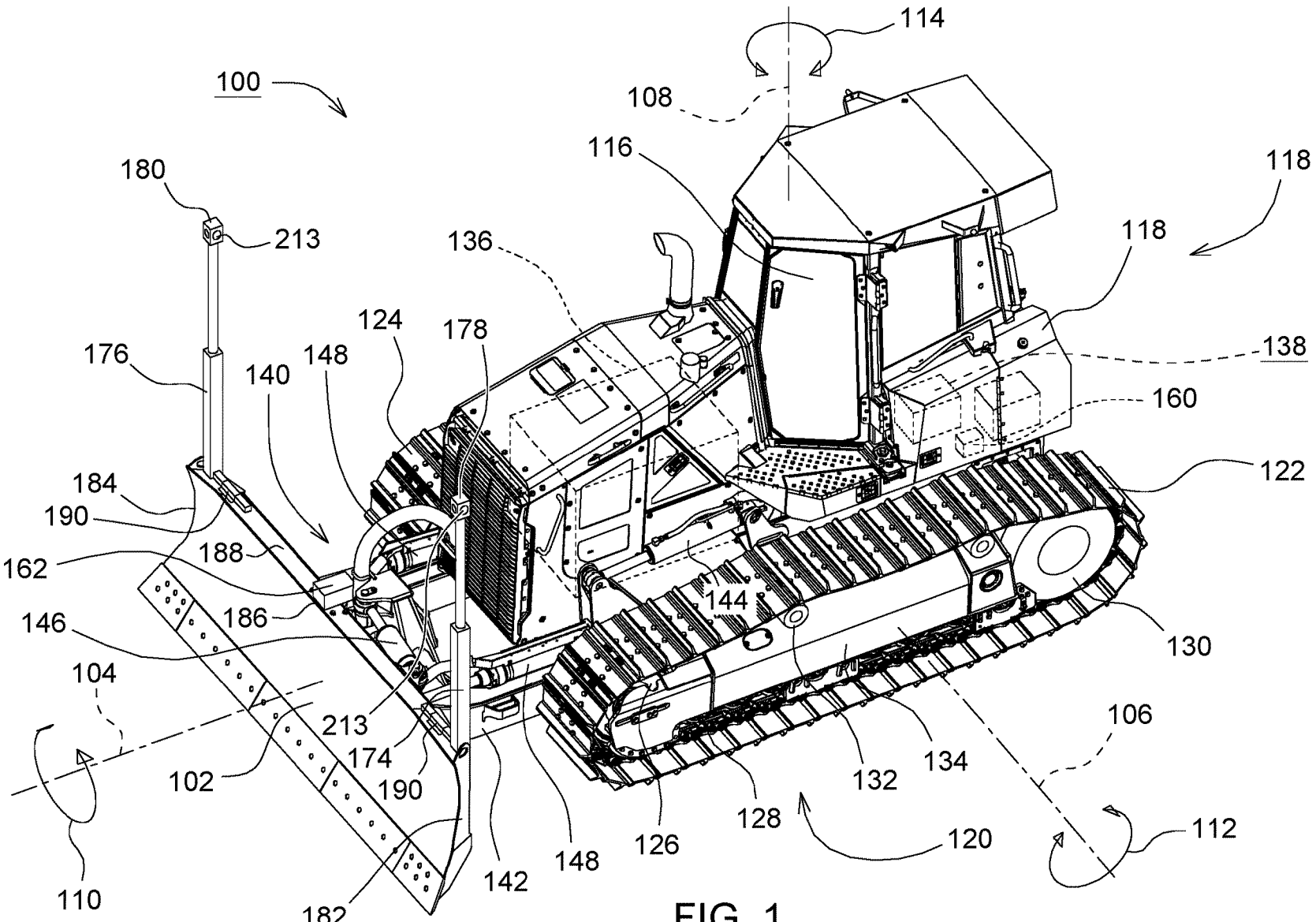
FIG. 1 is a perspective view of a work vehicle, specifically a crawler dozer, of the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected," "attached," "joined," "mounted," "fastened," and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof. Furthermore, any part of the apparatus of the present disclosure may be made using any applicable manufacturing method, such as, but not limited to 3D printing, injection molding, or the like.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components.

Figure 2:
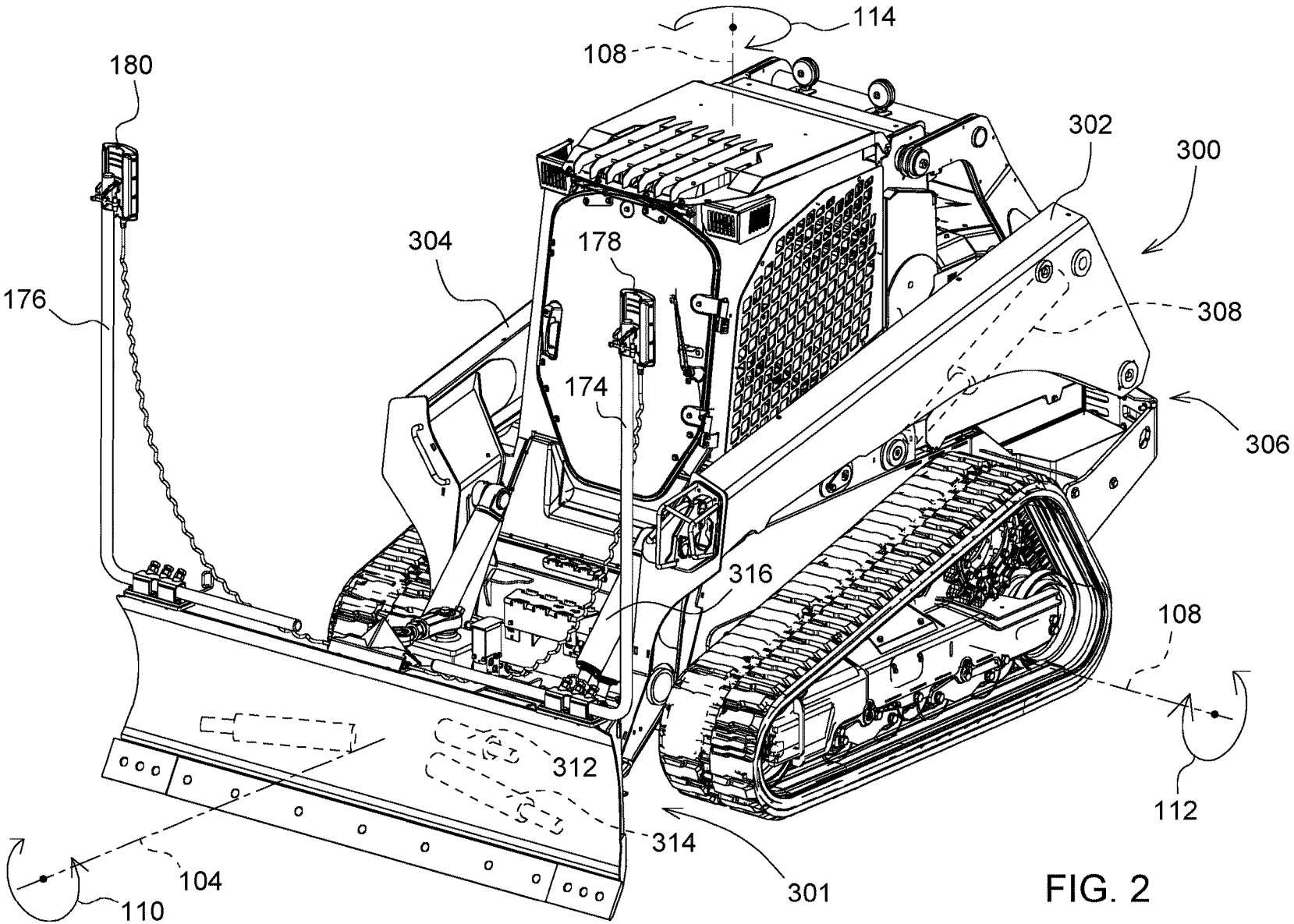
FIG. 2 is a perspective view of the work vehicle, specifically a skid steer loader, of the present disclosure.

Referring now to the drawings and particularly to FIG. 1, a work vehicle is shown and generally designated by the number 100. In the embodiment illustrated in FIG. 1, the work vehicle 100 is a crawler dozer, but may in other embodiments within the scope of the present disclosure be alternative work vehicles having a dozer blade 102 or other work implement such as a compact track loader, motor grader, scraper, skid steer, backhoe, and tractor, to name a few examples. As later discussed herein, the work vehicle 100 of FIG. 2 is a skid-steer loader.

The work vehicle 100 may be operable to engage the ground and grade, cut, and/or move material to achieve simple or complex features on the ground. While operating, the work vehicle 100 may experience movement in three directions and rotation in three directions. A direction of the work vehicle 100 may also be referred to with regard to a longitudinal direction 104, a latitudinal or lateral direction 106, and a vertical direction 108. Rotation for work vehicle 100 may be referred to as roll 110 or the roll direction, pitch 112 or the pitch direction, and yaw 114 or the yaw direction or heading.

An operator cab 116 may be located on a vehicle frame 118. The operator cab 116 and the dozer blade 102 may both be mounted to the frame 118 so that at least in certain embodiments the operator cab faces in the working direction of the dozer blade 102, such as for example where the dozer blade 102 is front-mounted.

The illustrated work vehicle 100 is supported on the ground by an undercarriage 120. The undercarriage 120 includes ground engaging units 122, 124, which in the present example are formed by a left track 122 and a right track 124 but may in certain embodiments be formed by alternative arrangement including wheeled ground engaging units, and provide tractive force for the work vehicle 100. Each track may be comprised of shoes with grousers that sink into the ground to increase traction, and interconnecting components that allow the tracks to rotate about front idlers 126, track rollers 128, rear sprockets 130, and top idlers 132. Such interconnecting components may include links, pins, bushings, and guides, to name a few components. Front idlers 126, track rollers 128, and rear sprockets 130, on both the left and right sides of the work vehicle 100, provide support for the work vehicle 100 on the ground. Front idlers 126, track rollers 128, rear sprockets 130, and top idlers 132 are all pivotally connected to the remainder of the work vehicle 100 and rotationally coupled to their respective tracks so as to rotate with those tracks. A track frame 134 provides structural support or strength to these components and the remainder of the undercarriage 120. In alternative embodiments, the ground engaging units 122, 124 may comprise, e.g., wheels on the left and right sides of the work vehicle.

Each of the rear sprockets 130 may be powered by a rotationally coupled hydraulic motor so as to drive the left track 122 and the right track 124 and thereby control propulsion and traction for the work vehicle 100. Each of the left and right hydraulic motors may receive pressurized hydraulic fluid from a hydrostatic pump whose direction of flow and displacement controls the direction of rotation for the left and right hydraulic motors. Each hydrostatic pump may be driven by an engine 136 (or equivalent power source) of the work vehicle 100 and may be controlled by an operator in the operator cab 116 issuing commands which may be received by a controller 138 and communicated to the left and right hydrostatic pumps. In alternative embodiments, each of the rear sprockets 130 may be driven by a rotationally coupled electric motor or a mechanical system transmitting power from the engine 136.

The dozer blade 102 of the present example is a blade which may engage the ground or material, for example to move material from one location to another and to create features on the ground, including flat areas, grades, hills, roads, or more complexly shaped features. In this embodiment, the dozer blade 102 of the work vehicle 100 may be referred to as a six-way blade, six-way adjustable blade, or power-angle-tilt (PAT) blade. The blade may be hydraulically actuated to move vertically up and down ("lift"), roll left or right ("tilt"), and yaw left and right ("angle"). Alternative embodiments may utilize a blade with fewer hydraulically controlled degrees of freedom, such as a 4-way blade that may not be angled or actuated in the direction of yaw 114.

The dozer blade 102 is movably connected to the frame 118 of the work vehicle 100 through a linkage 140 which supports and actuates the dozer blade 102 and is configured to allow the dozer blade 102 to be lifted (i.e., raised or lowered in the vertical direction 108) relative to the vehicle frame 118. The linkage 140 of the illustrated embodiment includes a C-frame 142, a structural member with a C-shape positioned rearward of the dozer blade 102, with the C-shape open toward the rear of the work vehicle 100. The dozer blade 102 may be lifted (i.e., raised or lowered) relative to the vehicle frame 118 by the actuation of lift cylinders 144, which may raise and lower the C-frame 142. The dozer blade 102 may be tilted relative to the vehicle frame 118 by the actuation of a tilt cylinder 146, which may also be referred to as moving the dozer blade 102 in the direction of roll 110. The dozer blade 102 may be angled relative to the vehicle frame 118 by the actuation of angle cylinders 148, which may also be referred to as moving the blade in the direction of yaw 114. Each of the lift cylinders 144, tilt cylinders 146, and angle cylinders 148 may be a double acting hydraulic cylinder.

Referring now to FIG. 2, in alternative embodiments such as in the case of the skid-steer loader 300, a linkage 301 includes a left boom arm 302 and a right boom arm 304. The boom arms 302, 304 are supported either directly or indirectly from a vehicle frame 306. The boom arms 302, 304 are pivotally connected to the vehicle frame 306 allowing the skid-steer loader 300 to lift (i.e., raise or lower) the boom arms 302, 304, which in turn raises and lowers the dozer blade 102. The skid-steer loader 300 may raise and lower the boom arms 302, 304 via the extension and retraction of left and right boom support cylinders 308, 310. The boom support cylinders 308, 310 may be hydraulic cylinders or electrically powered linear actuators. The left and right boom cylinders 308, 310 are each pivotally coupled at an end to the vehicle frame 306 and at an opposite end to the left and right boom arms 302, 304, respectively. The dozer blade 102 may be tilted relative to the vehicle frame 306 by the actuation of tilt cylinders 312, which may also be referred to as moving the dozer blade 102 in the direction of roll 110. The dozer blade 102 may be angled relative to the vehicle frame 306 by the actuation of angle cylinders 314, which may also be referred to as moving the blade in the direction of yaw 114. The dozer blade 102 may be pitched relative to the vehicle frame 306 by the actuation of pitch cylinders 316, which may also be referred to as moving the dozer blade 102 in the direction of pitch 112.

A control station including a user interface 150 (not shown in FIG. 1) may be located in the operator cab 116. As used herein, directions with regard to the work vehicle 100 may be referred to from the perspective of an operator seated within the operator cab 136: the left of work vehicle 100 is to the left of such an operator, the right of work vehicle 100 is to the right of the such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator.

Figure 3:
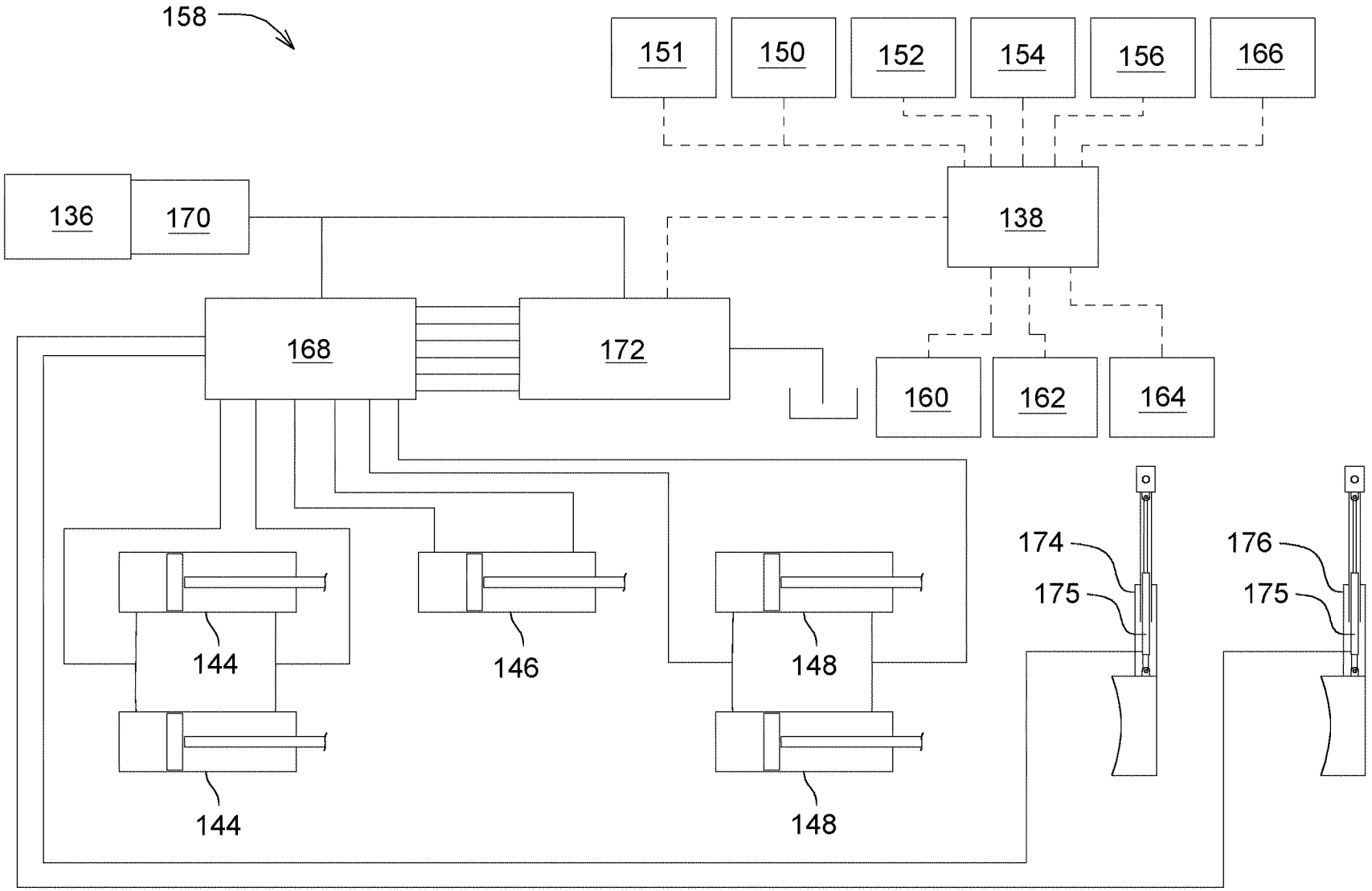
FIG. 3 is a block diagram representing an exemplary control system for the work vehicle of the present disclosure.
Figure 4A:
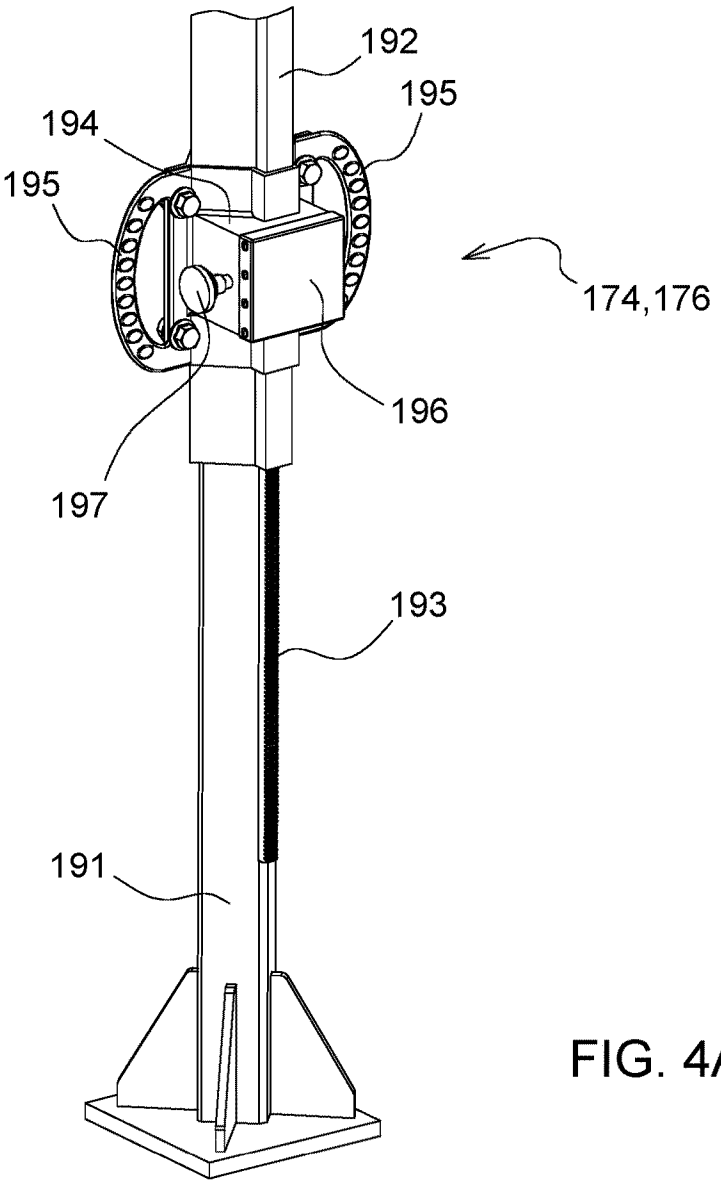
FIG. 4A is a perspective view of a support of the present disclosure.
Figure 4B:
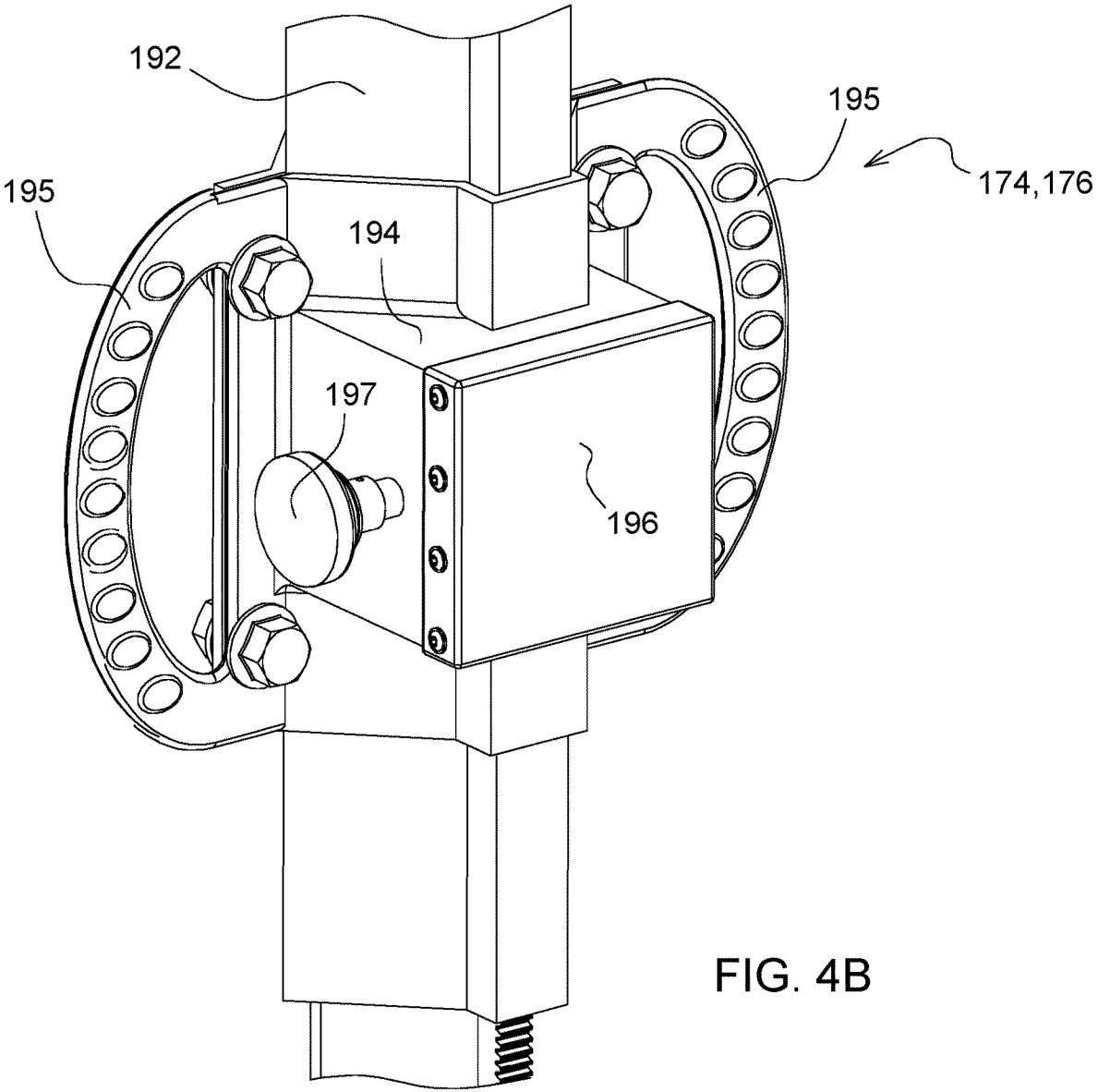
FIG. 4B is a perspective view of the support of the present disclosure.
Figure 4C:
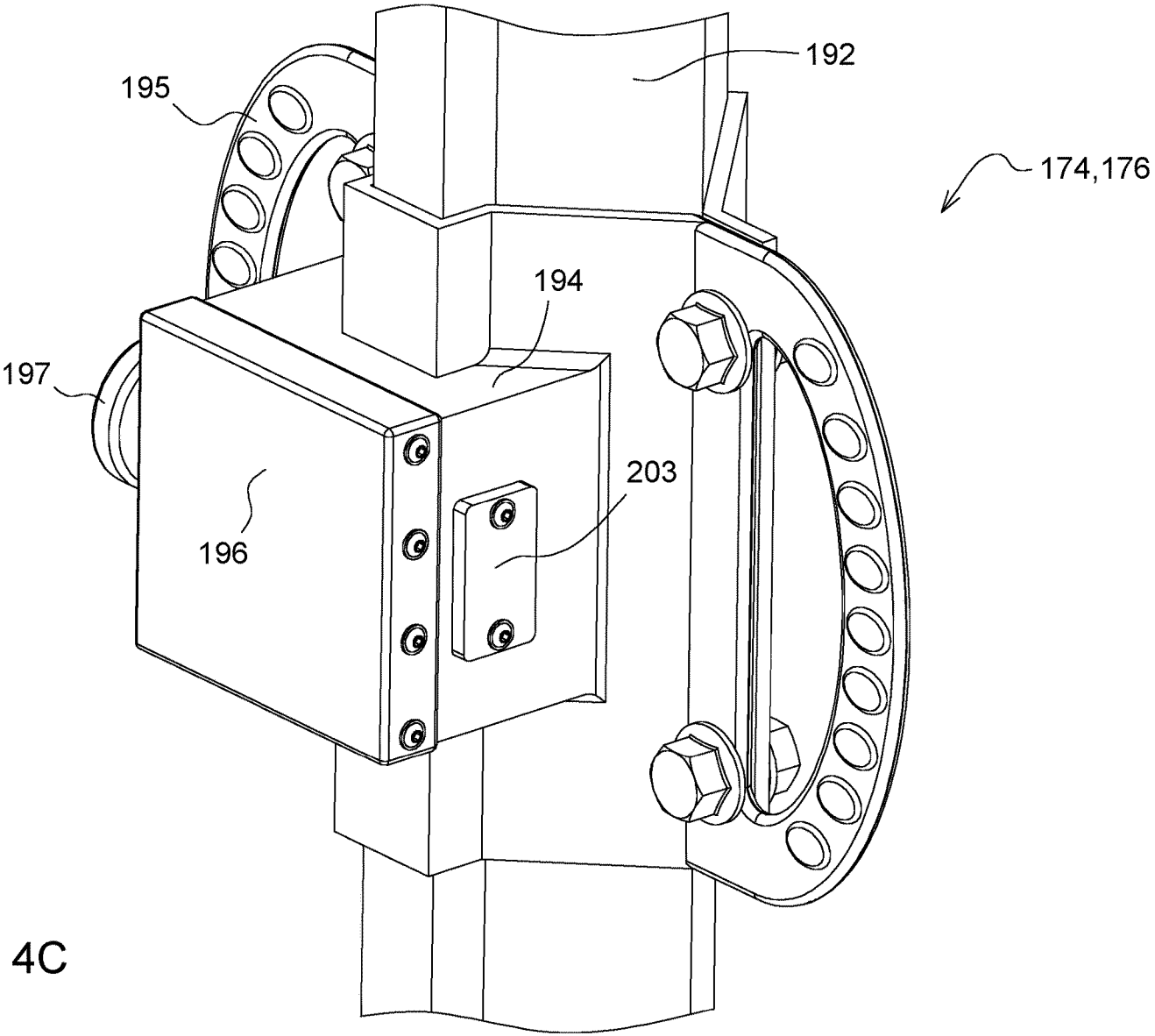
FIG. 4C is a perspective view of the support of the present disclosure.
Figure 4D:
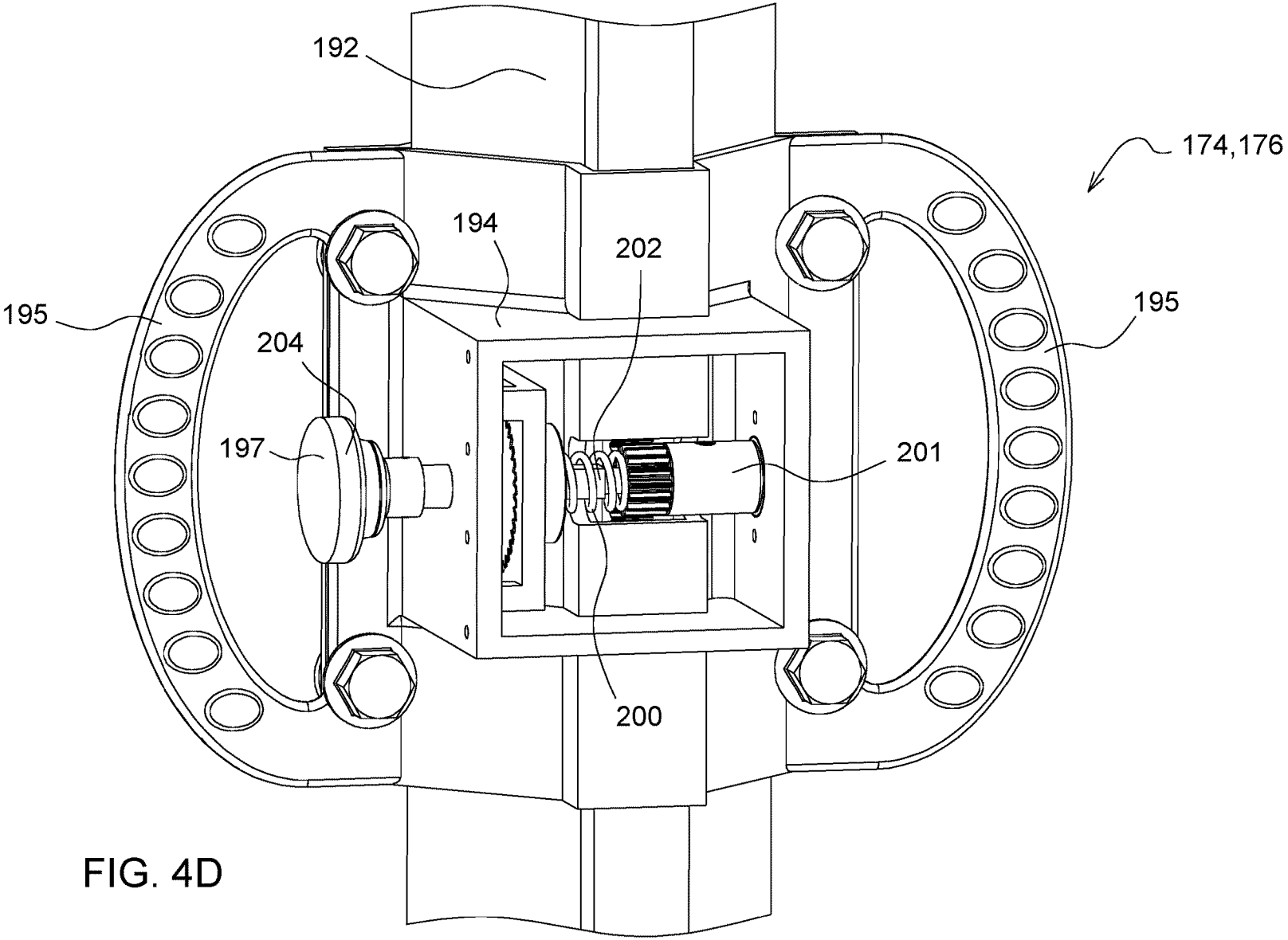
FIG. 4D is a perspective view of the support of the present disclosure wherein a case cover is removed.
Figure 4E:
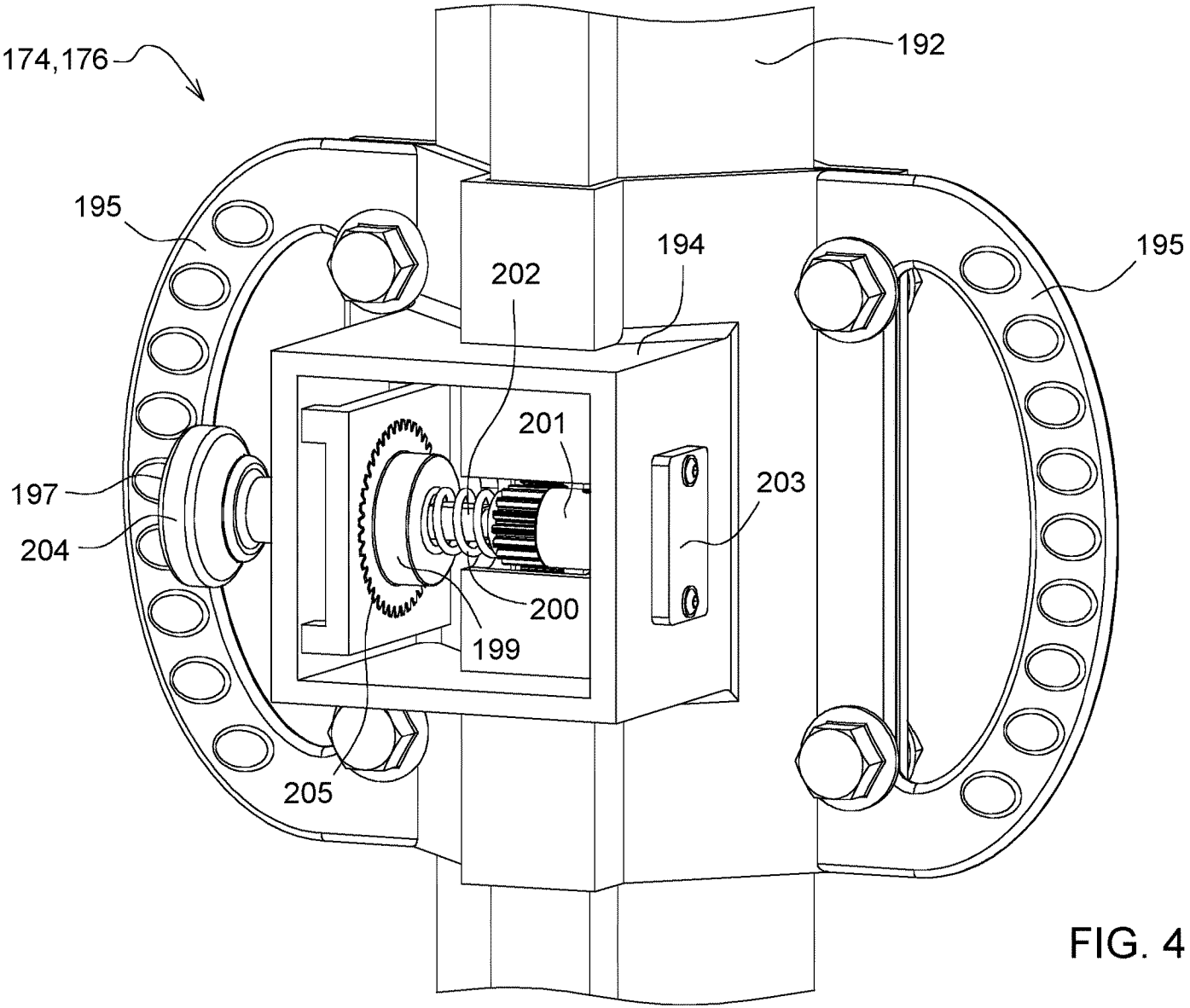
FIG. 4E is a perspective view of the support of the present disclosure wherein the case cover is removed.
Figure 4F:
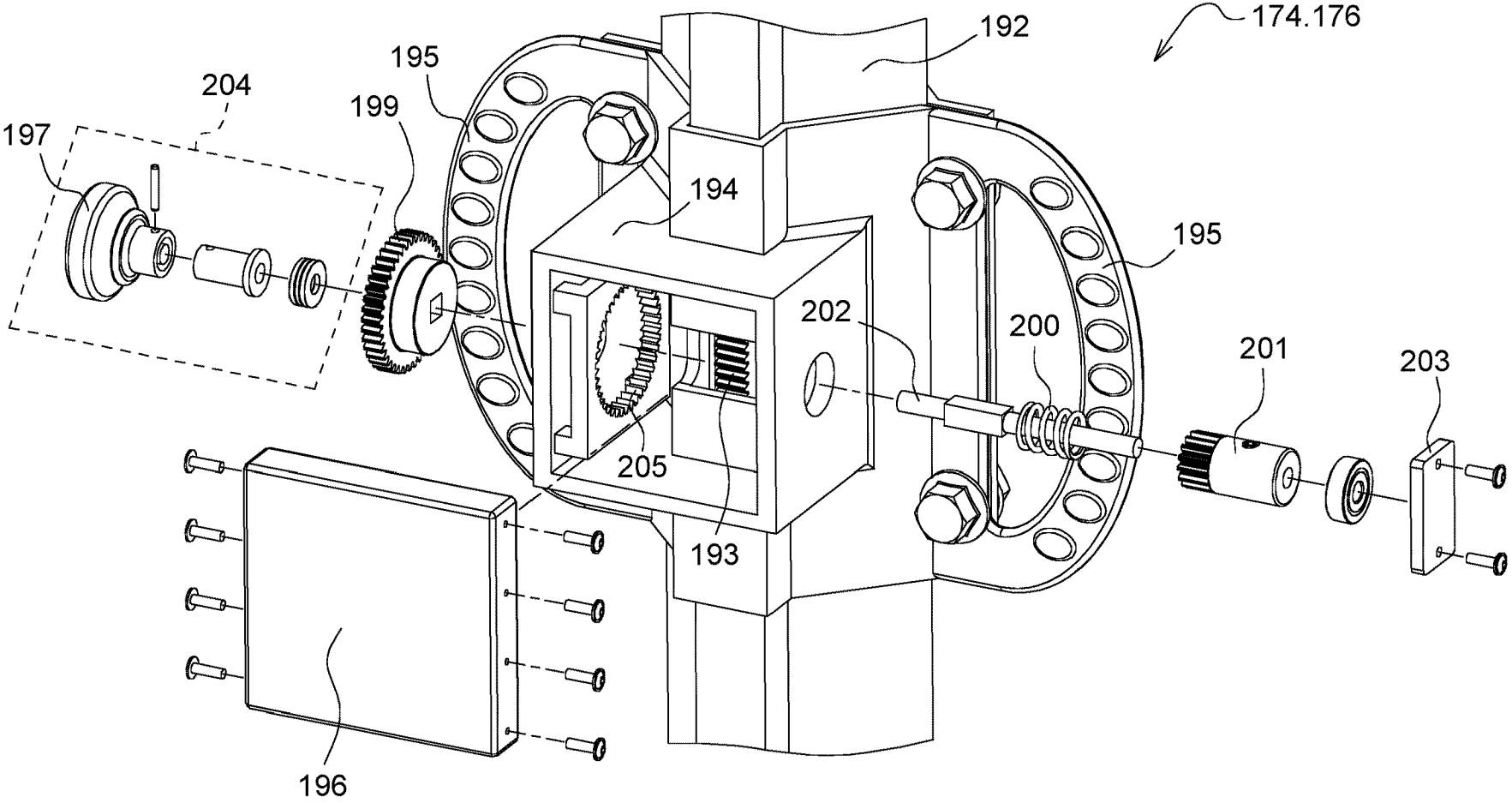
FIG. 4F is an exploded perspective view of the support of the present disclosure.
Figure 4G:
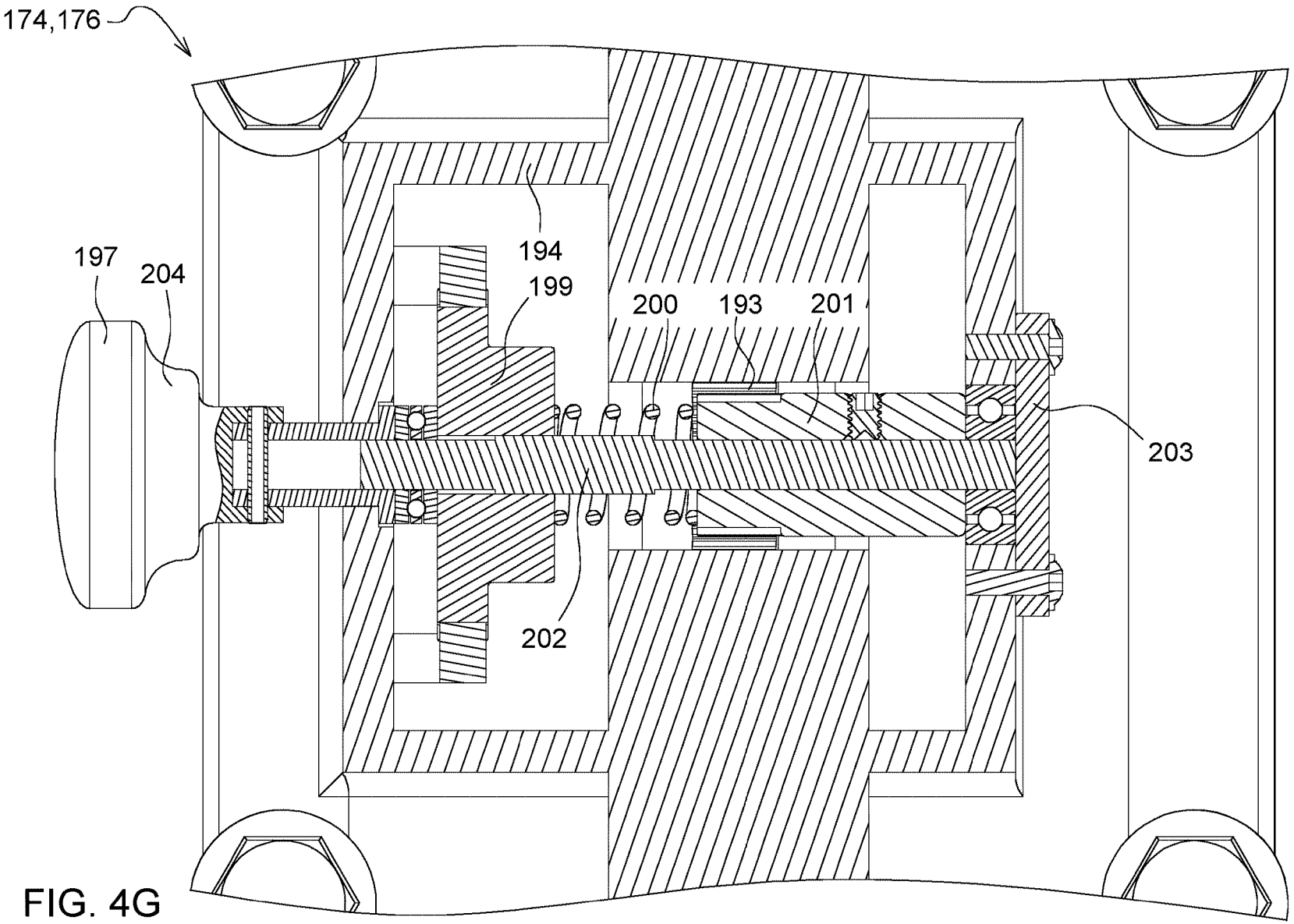
FIG. 4G is a section view of the support of the present disclosure.
Figure 4H:
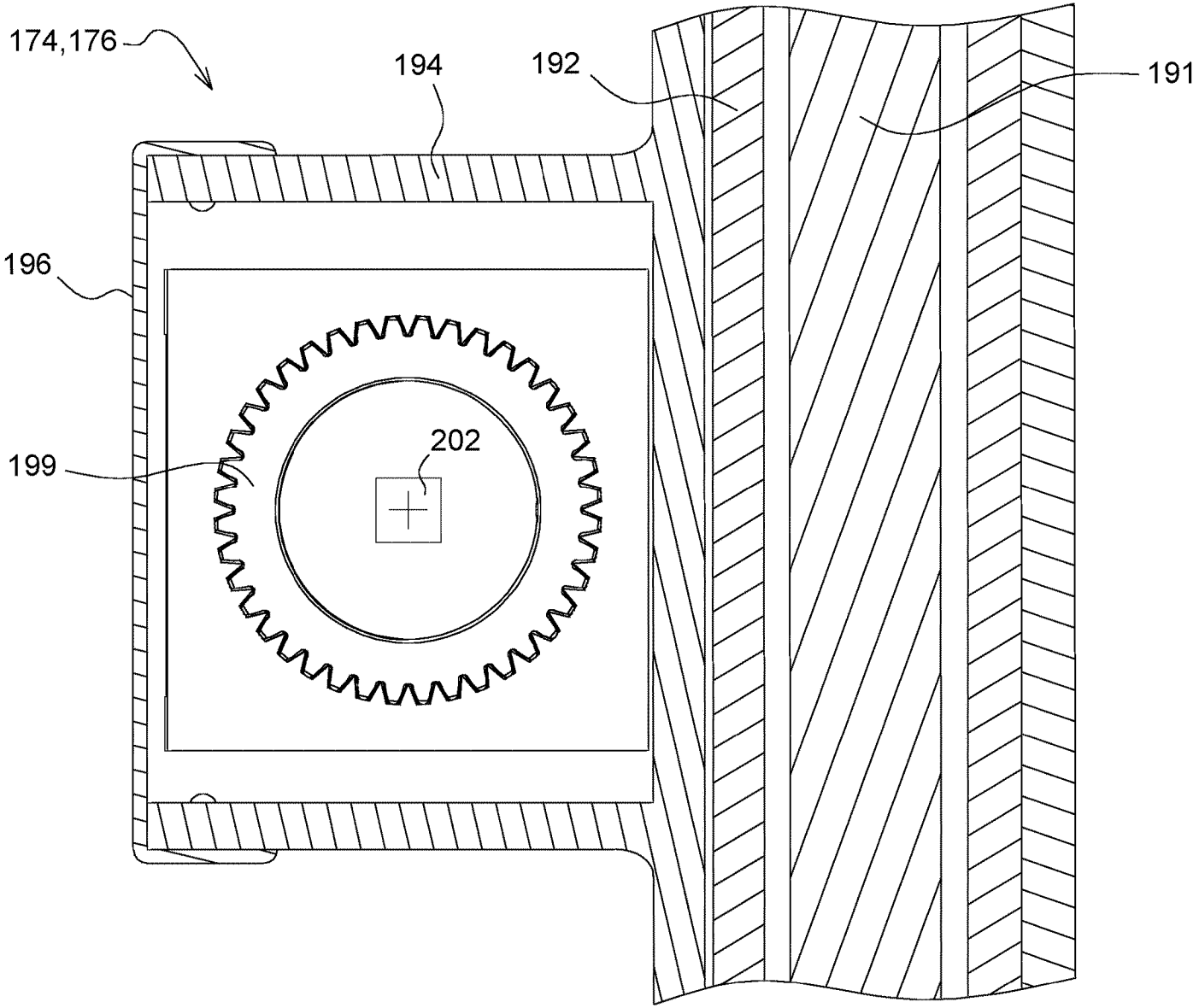
FIG. 4H is a section view of the support of the present disclosure.
Figure 5:
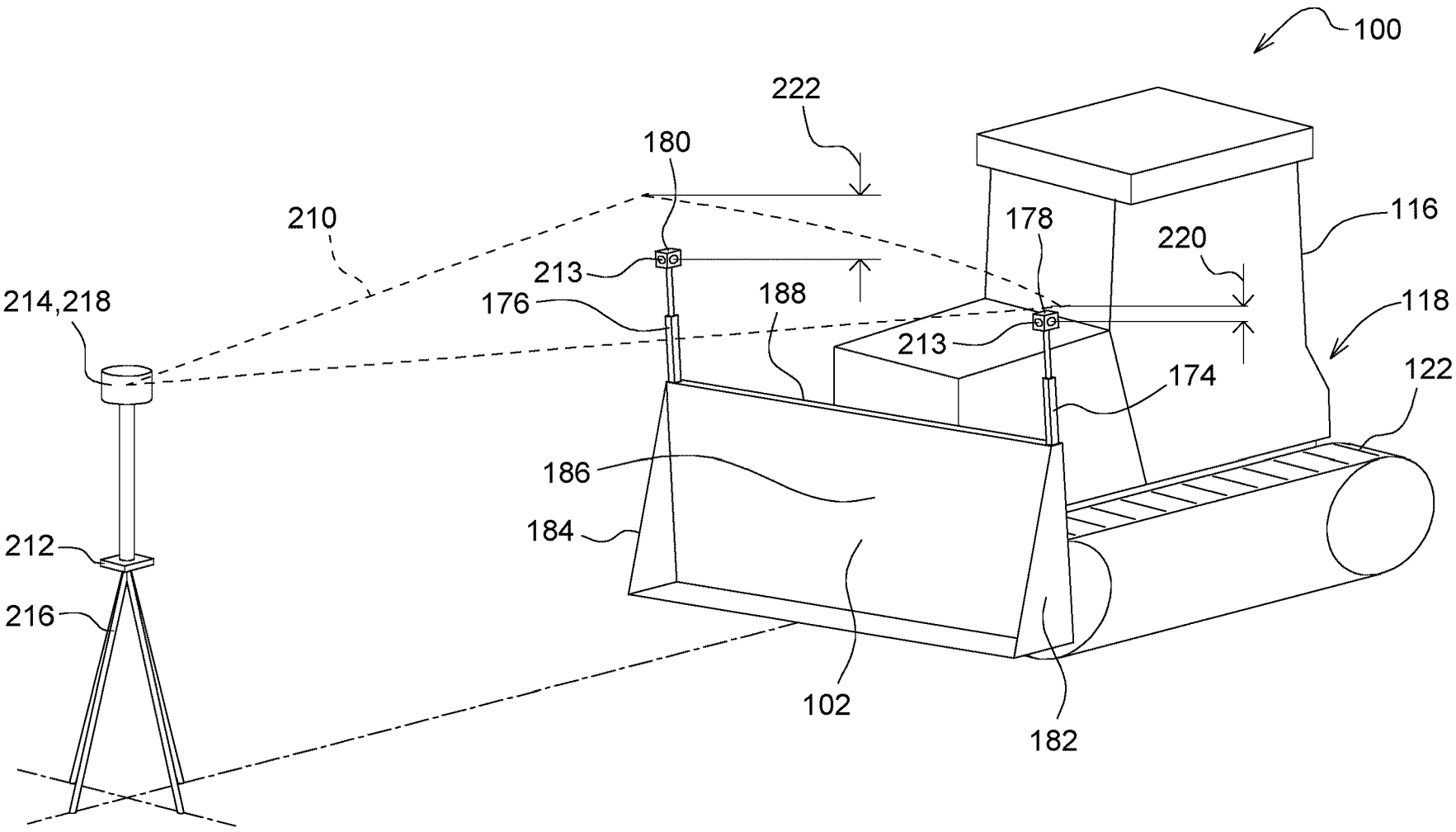
FIG. 5 is a perspective of the rotating laser and the work vehicle of the present disclosure wherein the work vehicle is in a reference position.
Figure 6:
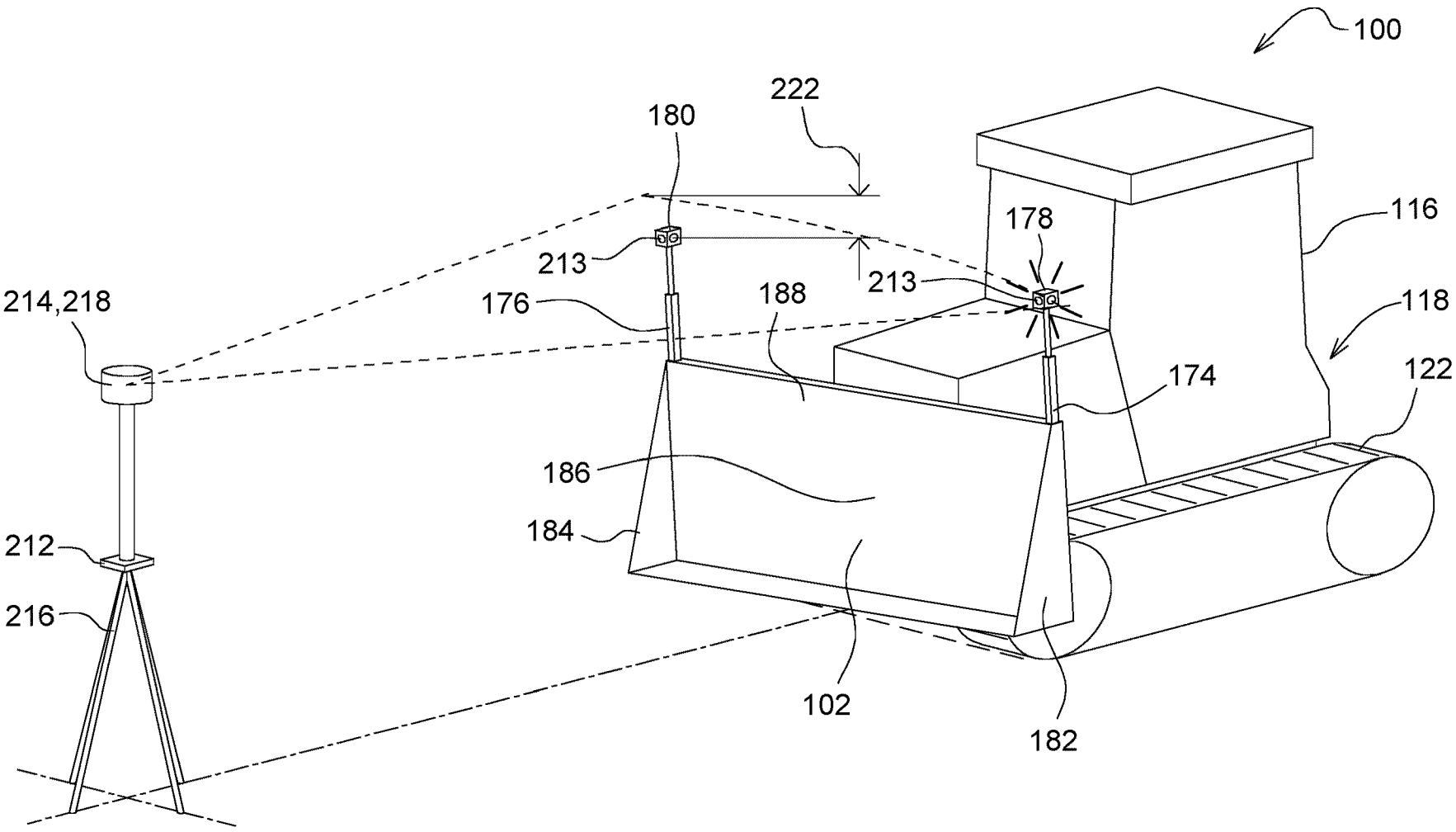
FIG. 6 is a perspective view of the rotating laser and the work vehicle of the present disclosure wherein the work vehicle is in a first calibration position.
Figure 7:
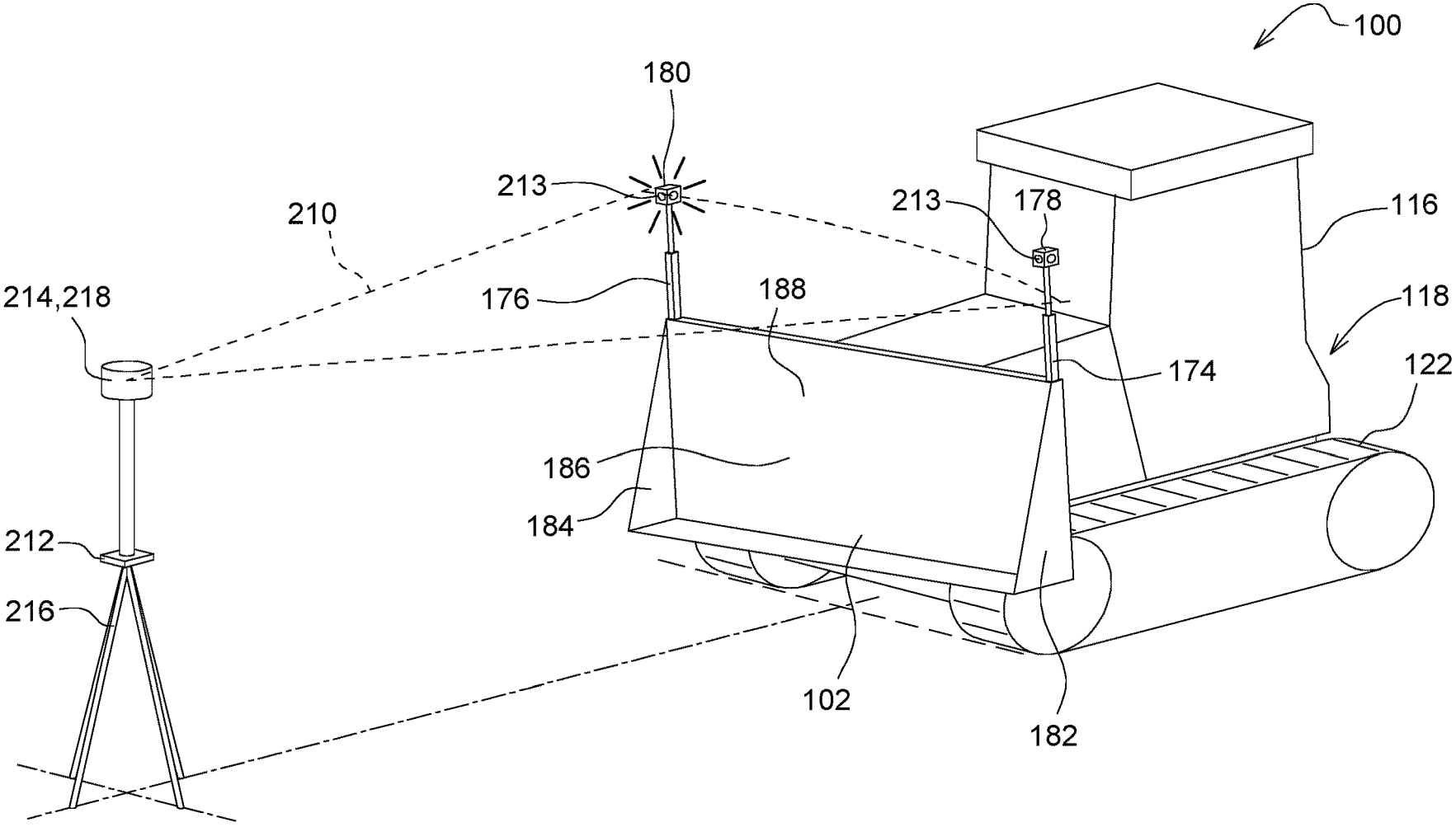
FIG. 7 is a perspective view of the rotating laser and the work vehicle of the present disclosure wherein the work vehicle is in a second calibration position.
Figure 8:
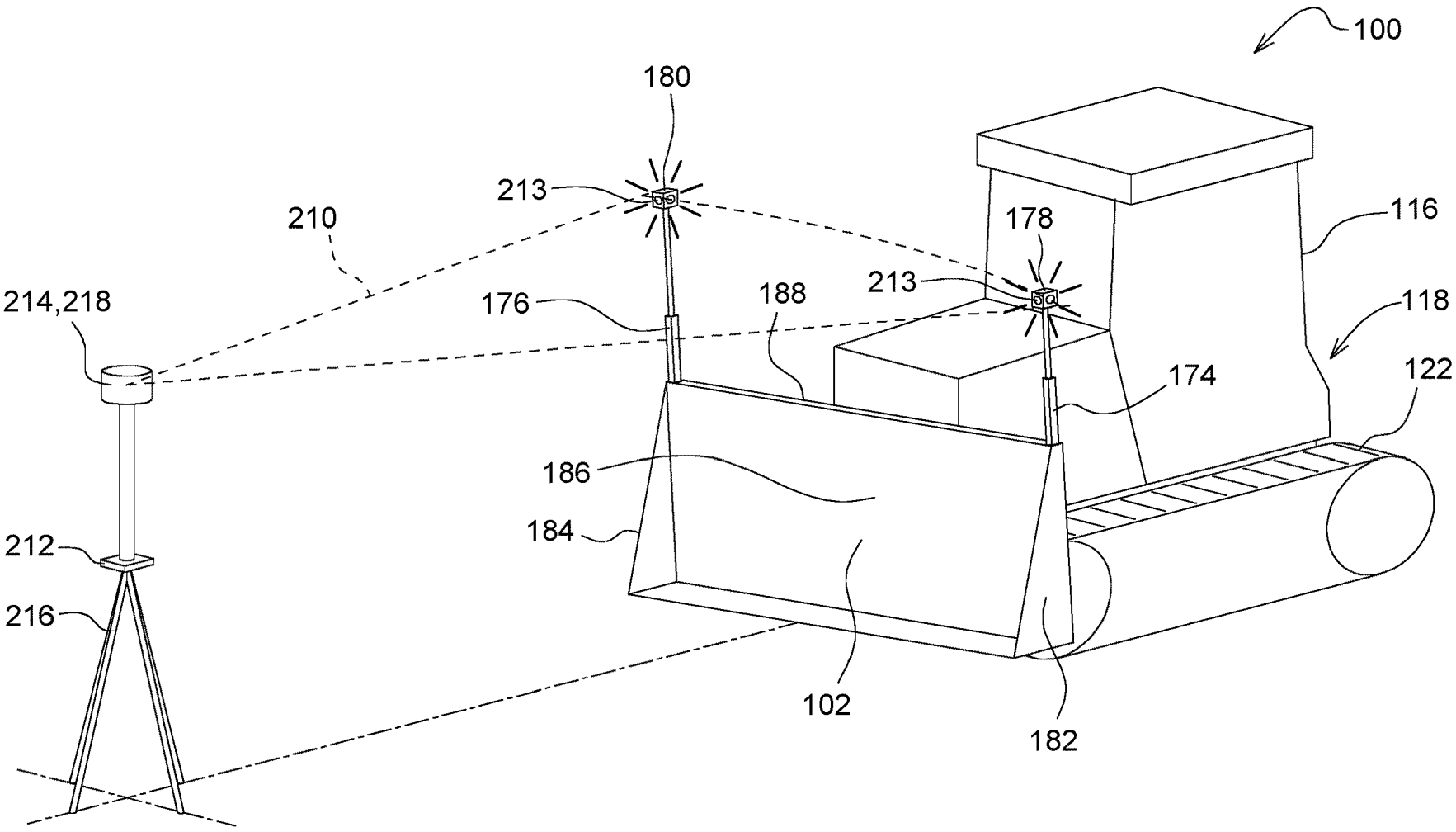
FIG. 8 is a perspective view of the rotating laser and the work vehicle of the present disclosure wherein a first and second sensor of the work vehicle detect a laser signal plane emitted by the rotating laser.

The term "user interface" 150 as used herein may broadly take the form of a display unit 151 and/or other outputs from the system such as indicator lights, audible alerts, and the like. Referring now to FIG. 3, the user interface 150 may further include, or additional components associated with the user interface may include, various user interface tools (e.g., including a first joystick 152 located on the left side of an operator while seated in the operator cab 116, a second joystick 154 located on the right side of an operator while seated in the operator cab 116, and a button 156 which may be located on a control panel, dashboard, or otherwise integrated with one of the joysticks 152, 154 as further described below) for operating various aspects of the work vehicle 100, including operation of the engine 136, positioning of the dozer blade 102, and the like. Such an onboard user interface 150 and associated tools 152, 154, 156 may be coupled to a vehicle control system via for example a CAN bus arrangement or other equivalent forms of electrical and/or electro-mechanical signal transmission. Another form of user interface (not shown) may take the form of a display unit 151 that is generated on a remote (i.e., not onboard) computing device, which may display outputs such as status indications and/or otherwise enable user interaction such as the providing of inputs to the system. In the context of a remote user interface, data transmission between for example the vehicle control system and the user interface 150 may take the form of a wireless communications system and associated components as are conventionally known in the art.

The illustrated work vehicle 100 further includes a control system 158 including the controller 138. The controller 138 may be part of the machine control system 158 of the work vehicle 100, or it may be a separate control module. The controller 138 may include or be functionally linked to the user interface 150 and optionally be mounted in the operators cab 116 at a control panel. It may be understood that the controller 138 described herein may be a single controller having some or all of the described functionality, or it may include multiple controllers wherein some or all of the described functionality, or it may include multiple controllers wherein some or all of the described functionality is distributed among the multiple controllers.

The controller 138 is configured to receive input signals from some or all of various sensors associated with the work vehicle 100, which may include for example a set of one or more vehicle frame orientation sensors 160 affixed to the frame 118 of the work vehicle 100 and configured to provide signals indicative of, e.g., a mainfall slope and a cross slope of the frame, a set of one or more dozer blade orientation sensors 162 affixed to the dozer blade 102 of the work vehicle 100 and configured to provide signals indicative of a position and orientation thereof, and one or more sensors 164, for example imaging devices 164, affixed to the work vehicle 100 and configured to capture images associated with components of the work vehicle 100 and/or the surroundings thereof. In alternative embodiments, such sensors 160, 162, 164 may not be affixed directly to the vehicle frame 118, dozer blade 102, or other components of the work vehicle 100, but may instead be connected through intermediate components or structures, such as rubberized mounts.

Frame orientation sensors 160 may be configured to provide at least a signal indicative of the inclination of the vehicle frame 118 relative to the direction of gravity, or to provide a signal or signals indicative of other positions or velocities of the frame, including its angular position, velocity, or acceleration in a direction such as the direction of roll 110, pitch 112, yaw 114, or its linear acceleration in a longitudinal direction 104, latitudinal direction 106, and/or vertical direction 108.

Frame orientation sensors 160 may be configured to directly measure inclination, or for example to measure angular velocity and integrate to arrive at inclination, and may typically, e.g., be comprised of an inertial measurement unit (IMU) mounted on the vehicle frame 118 and configured to provide at least a frame inclination (slope) signal, or signals corresponding to the slope of the frame 118, as inputs to the controller 138. Such an IMU may for example be in the form of a three-axis gyroscopic unit configured to detect changes in orientation of the sensor, and thus the frame 118 to which it is fixed, relative to an initial orientation.

In an embodiment each of the frame orientation sensor 160 and blade orientation sensor 162 may be in the form of an IMU which may comprise three accelerometers, each measuring linear acceleration in one of three perpendicular directions, and three gyroscopes, each measuring angular velocity in one of three perpendicular directions. In this way, frame orientation sensor 160 and blade orientation sensor 162 may each directly measure linear acceleration or angular velocity in any direction, including the directions of longitude 104, latitude 106, vertical 108, roll 110, pitch 112, and yaw 114.

It may be understood that the various sensors 160, 162 may transmit output signals representative of the respectively measured values to the controller 138, wherein the controller 138 is further configured to determine for example a position and orientation of the dozer blade 102 based on the received output signals. The controller 138 may be configured to compare the measured position and orientation of the dozer blade 102 to respective target values, wherein an error value may be calculated based on a difference between the measured position and a target position and an error value may be calculated based on a difference between the measured orientation and a target orientation. The error signals may then be used by the controller 138 to generate control signals to appropriate actuators. The measured position of the dozer blade 102 in an embodiment may correspond to a measured elevation of a ground-engaging portion of the dozer blade 102 with respect to a reference ground surface or to a reference component associated with the work vehicle 100, whereas the measured orientation in this embodiment may correspond to a measured tilt in a latitudinal/transverse axis of the dozer blade 102 with respect to the reference ground surface or to the reference component associated with the work vehicle 100.

The controller 138 in an embodiment may include or may be associated with a processor, a computer readable medium, a communication unit, data storage 166 such as for example a database network, and the aforementioned user interface 150 or control panel having a display.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work vehicle 100. The communications unit may include wireless communications system components (e.g., via cellular modem, WiFi, Bluetooth or the like) and/or may include one or more wired communications terminals such as universal serial bus ports.

Data storage 166 as discussed herein may, unless otherwise stated, generally encompass hardware such as volatile or non-volatile storage devices, drives, memory, or other storage media, as well as one or more databases residing thereon.

The control system 158 may include hydraulic and electrical components for controlling a position of the dozer blade 102. For example, each of the lift cylinders 144, the tilt cylinder 146, and the angle cylinders 148 may be hydraulically connected to a hydraulic control valve 168, which receives pressurized hydraulic fluid from a hydraulic pump 170, which may be rotationally connected to the engine 136, and directs such fluid to the lift cylinders 144, the tilt cylinder 146, the angle cylinders 148, and other hydraulic circuits or functions of the work vehicle 100. The hydraulic control valve 168 may meter such fluid out, or control the flow rate of hydraulic fluid to, each hydraulic circuit to which it is connected. In alternative embodiments, the hydraulic control valve 168 may not meter such fluid out but may instead only selectively provide flow paths to these functions while metering is performed by another component (e.g., a variable displacement hydraulic pump) or not performed at all. The hydraulic control valve 168 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In various embodiments, the controller 138 may send commands to actuate the dozer blade 102 in a number of different manners. As one example, the controller 138 may be in communication with a valve controller via a controlled area network (CAN) and may send command signals to the valve controller in the form of CAN messages. The valve controller may receive these messages from the controller 138 and send current to specific solenoids within an electrohydraulic pilot valve 172 based on those messages. As another example, the controller may actuate the dozer blade 102 by actuating an input in the operator cab 116. For example, an operator may use joystick 152 to issue commands to actuate the dozer blade 102, and the joystick 152 may generate hydraulic pressure signals, pilots, which are communicated to the hydraulic control valve 168 to cause the actuation of the work implement. In such a configuration, the controller 138 may be in communication with electrical devices (e.g., solenoids, motors) which may actuate joystick 166 in the operator cab 116. In this way, the controller may actuate the dozer blade 102 by actuating these electrical devices instead of communicating signals to electrohydraulic pilot valve 172.

The controller 138 of the work vehicle 100 may be configured to produce outputs to a user interface 150 associated with the display unit 151 for display to the human operator. The controller 138 may be configured to receive inputs from the user interface 150, such as user input provided via the user interface 150. Not specifically represented in FIG. 3, the controller 138 of the work vehicle 100 may in some embodiments further receive inputs from and generate outputs to remote devices associated with a user via a respective user interface, for example a display unit with touchscreen interface. Data transmission between for example the vehicle control system 158 and a remote user interface may take the form of a wireless communications system and associated components as are conventionally known in the art. In certain embodiments, a remote user interface and vehicle control system 158 for respective work machines may be further coordinated or otherwise interact with a remote server or other computing device for the performance of operations in a system as disclosed herein.

Referring back to FIGS. 1-2, the work vehicle 100 further includes at least one support and at least one sensor. The at least one support may include first and second supports 174, 176 and the at least one sensor may include first and second sensors 178, 180. The first and second supports 174, 176 are operable to support the first and second sensors 178, 180, respectively. In certain embodiments, the work vehicle 100 may only include the first support 174 and the first sensor 178.

Each support 174, 176 includes an upper portion and a lower portion. The lower portion of each support 174, 176 is coupled to the dozer blade 102. The lower portion of the first support 174 is coupled to the dozer blade 102 nearer to a dozer blade first end 182 than to a dozer blade second end 184. The lower portion of the second support 176 is coupled to the dozer blade 102 nearer to the dozer blade second end 184 than to the dozer blade first end 182. In the illustrated embodiment, the first support 174 is coupled to the dozer blade 102 such that the first sensor 178 is generally located at the dozer blade first end 182. Further in the illustrated embodiment, the second support 176 is coupled to the dozer blade 102 such that the second sensor 180 is generally located at the dozer blade second end 184. In alternative embodiments, the supports 174, 176 may be coupled to the dozer blade 102 such that the first and second sensors 178, 180 are nearer to a dozer blade center 186 than the first and second ends 182, 184. However, it is preferable for the first support 174 to be coupled nearer to the dozer blade first end 182 than to the dozer blade center 186 and for the second support 176 to be coupled nearer to the dozer blade second end 184 than to the dozer blade center 186.

In the illustrated embodiment, the first and second supports 174, 176 include a telescopic L-shaped post. The lower portion of the supports 174, 176 may be coupled to the dozer blade 102 at a dozer blade top end 188 by a plurality of couplers 190 configured to receive and retain the lower portions of the supports 174, 176. In an alternative embodiment, the supports 174, 176 may include a telescopic elongate post. The lower portion of the supports 174, 176 may extend along a backside of the dozer blade 102 and be coupled thereto. In another alternative embodiment, the supports 174, 176 may include a telescopic elongate post with a base. The base may be configured to bolt onto a platform on the dozer blade top end 188. In another alternative embodiment, the supports 174, 176 may include a telescopic elongate post with a magnetic portion nearer to the lower portion of the support than the upper portion of the support and configured to magnetically couple the support to the dozer blade 102. While these are examples of way in which the supports 174, 176 may be coupled to the dozer blade 102, those of skill in the art will appreciate other configurations are possible.

The first and second supports 174, 176 are extendable. In one optional embodiment, the first and second supports 174, 176 each include a linear actuator 175 operable to adjust the height of the upper portion of the support. The linear actuator 175 may be a hydraulic cylinder or an electrically powered linear actuator, to name a few examples. Each linear actuator 175 may be adjustable by an operator control input accessible by an operator in the operator cab 116. The operator control input could be connected to each linear actuator 175 via a wired or wireless connection. In an alternative embodiment, the operator control input could be mounted directly on the first and second supports 174, 176. In another alternative embodiment, each linear actuator 175 may be controlled by the controller 138.

Referring now to FIGS. 4A-4H, in one optional embodiment, the height of the upper portion of the first and second supports 174, 176 may be manually adjusted by a user. Each of the first and second supports 174, 176 includes an inner support member 191 and an outer support member 192. The inner support member 191 may be received within the outer support member 192. The inner support member 191 includes a gear teeth track 193 extending along a length of the inner support member 191. The gear teeth track 193 may extend along the entire length of the inner support member 191 or only a portion of the length of the inner support member 191.

A case 194 is coupled to the outer support member 192. The case 194 includes a plurality of handles 195 configured to be grasped by a user. The case 194 further includes a case cover 196 removably coupled to the case 194 and configured to enclose an interior of the case 194. The case cover 196 may be removed to expose the interior of the case 194.

A locking assembly 197 may be at least partially housed within the interior of the case 194. The locking assembly 197 includes a locking gear 199, a spring 200, and a track gear 201. The locking gear 199, spring 200, and track gear 201 are each mounted on a central rod 202. A first end of the central rod 202 abuts an end plate 203 coupled to a side the case 194. A button assembly 204 is coupled to an opposite side of the case 194. The button assembly 204 receives a second end of the central rod 202 therein and is configured to translate relative to the case 194 and central rod 202. The track gear 201 is coupled to the central rod 202 so that it may not translate along the central rod 202 or rotate independent of the central rod 202. The track gear 201 engages the gear teeth track 193 of the inner support member 191 through a cutout defined through the case 194 and outer support member 192. The spring 200 is axially disposed about the central rod 202 and positioned between the track gear 201 and the locking gear 199. The locking gear 199 is coupled to the central rod 202 so that the locking gear 199 may not rotate independent of the central rod 202.

The case 194 further includes a locking gear cutout 205 that is configured to receive the locking gear 199 therein. When the locking gear 199 is received within the locking gear cutout 205, the locking gear 199 may not rotate. The spring 200 is operable to bias the locking gear 199 into the locking gear cutout 205. Pressing the button assembly 204 causes the button assembly 204 to translate relative to the case 194 and the central rod 202, push against the locking gear 199 and compress the spring 200, and cause the locking gear 199 to disengage the locking gear cutout 205 of the case 194.

The locking assembly 197 includes a locked configuration and an unlocked configuration. In the locked configuration, translation of the outer support member 192 relative to the inner support member 191 is prevented. Specifically, the button assembly 204 is unpressed and the spring 200 causes the locking gear 199 to engage the locking gear cutout 205 of the case 194. Thus, the locking gear cutout 205 prevents rotation of the locking gear 199, which in turn prevents the central rod 202 and track gear 201 from rotating. The stationary track gear 201 prevents movement of the gear teeth track 193 of the inner support member 191.

In the unlocked configuration, the outer support member 192 may translate relative to the inner support member 191. Specifically, the button assembly 204 is pressed and translates the locking gear 199 along the central rod 202 compressing the spring 200. The locking gear 199 disengages the locking gear cutout 205 of the case 194 and the locking gear 199 is no longer prevented from rotating. Thus, the locking gear 199, central rod 202, and track gear 201 may rotate relative to the case. Further, the track gear 201 may rotate relative to the gear teeth track 193. A user may grasp one of the plurality of handles 195 and translate the outer support member 192 relative to the inner support member 191. As the outer support member 192 is translated relative to the inner support member 191, the gear teeth track 193 is translated relative to the track gear 201. Once the outer support member 192 reaches a desired position, the user may release the button assembly 204, thus placing the locking assembly 197 back into the locked configuration.

Referring now to FIGS. 5-8, the first sensor 178 is mounted to the upper portion of the first support 174 and the second sensor 180 is mounted to the upper portion of the second support 176. The first and second sensors 178, 180 are configured to detect a laser signal plane 210 emitted by a rotating laser 212 at a detection portion 213 of the sensor.

Rotating lasers 212 are known in the art and are configured in various ways. In the illustrated embodiment, the rotating laser 212 comprises a head portion 214 mounted on a tripod 216. The head portion 214 often includes a self-leveling feature. The head portion 214 includes a laser emitter 218 operable to emit a laser signal. The head portion 214 rotates the laser emitter 218 at a constant rotational speed thus forming the laser signal plane 210. The rotational speed at which the laser emitter 218 rotates may be adjusted by the operator. The laser emitter 218 is configured such that an operator may select the slope of the laser signal plane 210 emitted by the rotating laser 212. The first and second sensor 178, 180 are configured to detect a laser signal plane 210 emitted by various configurations and brands of rotating lasers 212.

The operator may select the orientation of the work vehicle 100 relative to the rotating laser 212. The direction the work vehicle 100 travels as it engages the ground is referred to herein as the intended grading direction. Preferably, the work vehicle 100 will be oriented wherein the intended grading direction is toward the rotating laser 100. One advantage of this orientation may be that the first and second sensors 178, 180 face the rotating laser 100 allowing for more reliable detection of the laser signal plane 210 with less chance of obstruction. Alternatively, the intended grading direction of the work vehicle 100 may be in any direction relative to the rotating laser 100 so long as the laser signal plane 210 may be detected by the first and second sensors 178, 180. Irrespective of the orientation of the work vehicle 100 relative to the rotating laser 212, the work vehicle 100 may grade in the direction along a mainfall slope, a cross-slope, or a mixture of the two.

Automatic Find Mode

The controller 138 includes an automatic find mode. In the automatic find mode, the controller 138 is configured to determine a first difference in height 220 of the dozer blade 102 relative to the vehicle frame 118 between a reference position and a first calibration position. In embodiments of the work vehicle 100 having only a single sensor, only the first difference in height 220 needs to be determined.

In the reference position, the dozer blade 102 engages the ground and is oriented at a desired cross-slope relative to the laser signal plane 210. Further, the first and second sensor 178, 180 are positioned below the laser signal plane 210. The operator determines the desired cross-slope. The operator orients the dozer blade 102 at the desired cross-slope through either manipulation of manual controls or by inputting the desired cross-slope into the control system 158. The work vehicle 100 is shown in one such reference position in FIG. 5.

In the first calibration position, the first sensor 178 is at a desired height relative to the laser signal plane 210. The work vehicle 100 is shown in one such first calibration position in FIG. 6. The desired height relative to the laser signal plane 210 may vary based on the application and is determined by the operator. For example, in anticipation of the work vehicle 100 grading along a negative mainfall slope, the desired height of the first sensor 178 relative to the laser signal plane 210 may be where the laser signal plane 210 is detected at a lower portion of the detection portion 213 of the first sensor 178 In another example, in anticipation of the work vehicle 100 grading along a positive mainfall slope, the desired height of the first sensor 178 relative to the laser signal plane 210 may be where the laser signal plane 210 is detected at an upper portion of the detection portion 213 of the first sensor 178.

To determine the first difference in height 220 of the dozer blade 102 relative to the vehicle frame 118, in the laser receiver automatic find mode the controller 138 is preferably configured to raise the dozer blade 102 from the reference position to the first calibration position. Alternatively, to determine the first difference in height 220 of the dozer blade 102 relative to the vehicle frame 118, in the laser receiver automatic find mode the controller 138 may be configured to lower the dozer blade 102 from the first calibration position to the reference position.

In the automatic find mode, the controller 138 is further configured to determine a second difference in height 222 of the dozer blade 102 relative to the vehicle frame 118 between the reference position and a second calibration position. The work vehicle 100 is shown in one such second calibration position in FIG. 7.

In the second calibration position, the second sensor 180 is at a desired height relative to the laser signal plane 210. Again, the desired height relative to the laser signal plane 210 may vary based on the application and is determined by the operator. To determine the second difference in height 222 of the dozer blade 102 relative to the vehicle frame 118, in the laser receiver automatic find mode the controller 138 is preferably configured to raise the dozer blade from the first calibration position to the second calibration position. Alternatively, to determine the second difference in height 222 of the dozer blade 102 relative to the vehicle frame 118, in the laser receiver automatic find mode the controller 138 may be configured to raise the dozer blade 102 from the reference position to the second calibration position. Alternatively, to determine the second difference in height 222 of the dozer blade 102 relative to the vehicle frame 118, in the laser receiver automatic find mode the controller 138 may be configured to lower the dozer blade 102 from the second calibration position to the first calibration position. Alternatively, to determine the second difference in height 222 of the dozer blade 102 relative to the vehicle frame 118, in the laser receiver automatic find mode the controller 138 may be configured to raise the dozer blade 102 from the second calibration position to the reference position.

Thus, the preferable method of determining the first and second difference in height 220, 222 of the dozer blade 102 relative to the vehicle frame 118 is as follows: placing the dozer blade 102 at the reference position, raising the dozer blade 102 from the reference position to the first calibration position, and continuing to raise the dozer blade 102 from the first calibration position to the second calibration position.

In the laser receiver automatic find mode, the controller 138 is further configured to display the first difference in height 220 and the second difference in height 222 on an operator display interface in the operator cab 116. The operator display interface could be the display unit 151 associated with the user interface 150. The operator may then extend the first support 174 a distance equal to the first difference in height 220 and extend the second support 176 a distance equal to the second difference in height 222. Typically, the operator would return the dozer blade 102 to the reference position before making such adjustments. The dozer blade 102 is configured in the reference position with the first and second supports 174, 176 adjusted such that each detects the laser signal plane 210 in FIG. 8.

As previously discussed, the operator may extend the first and second supports 174, 176 from the operator cab 116 or, alternatively, exit the operator cab 116 to extend the supports 174, 176. In the embodiment wherein the first and second supports 174, 176 include linear actuator 175, in the laser receiver automatic find mode the controller 138 is configured to return the dozer blade 102 to the reference position, automatically extend the linear actuator 175 of the first support 174 relative to the dozer blade 102 a distance equal to the first difference in height 220, and automatically extend the linear actuator 175 of the second support 176 relative to the dozer blade 102 a distance equal to the second difference in height 222. In the laser receiver automatic find mode the controller 138 is further configured to verify that the first and second sensors 178, 180 detect the laser signal plane 210 within a certain distance of the desired height. In the laser receiver automatic find mode the controller 138 may be configured to verify that the first and second sensors 178, 180 detect the laser signal plane 210 preferably within 25 millimeters of the desired height, more preferably within 15 millimeters of the desired height, and most preferably within 9 millimeters of the desired height.

Figure 9:
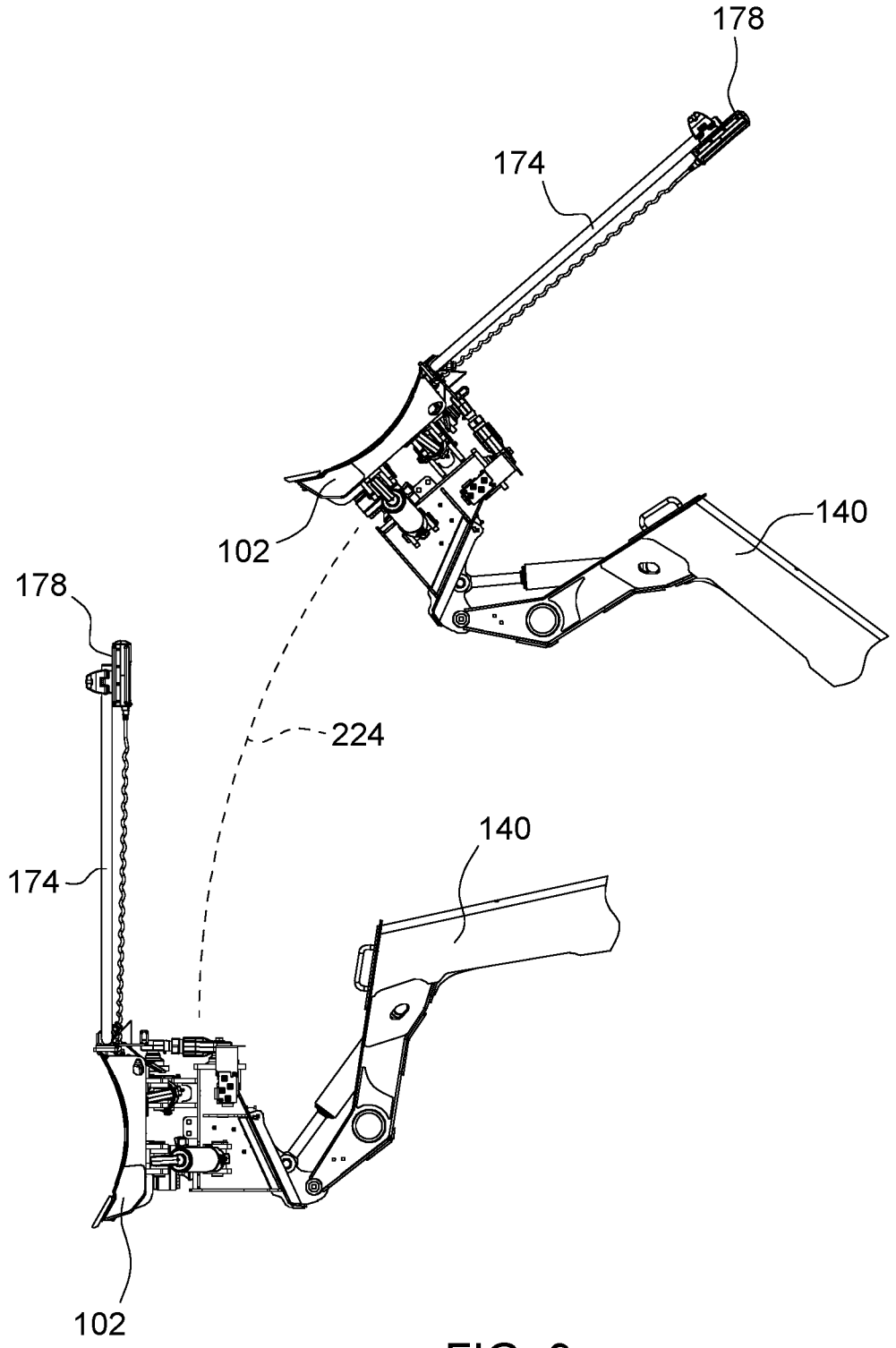
FIG. 9 is a schematic view of a linkage of a work vehicle of the present disclosure wherein the linkage is schematically illustrated translating a dozer blade along a lift path.
Figure 10:
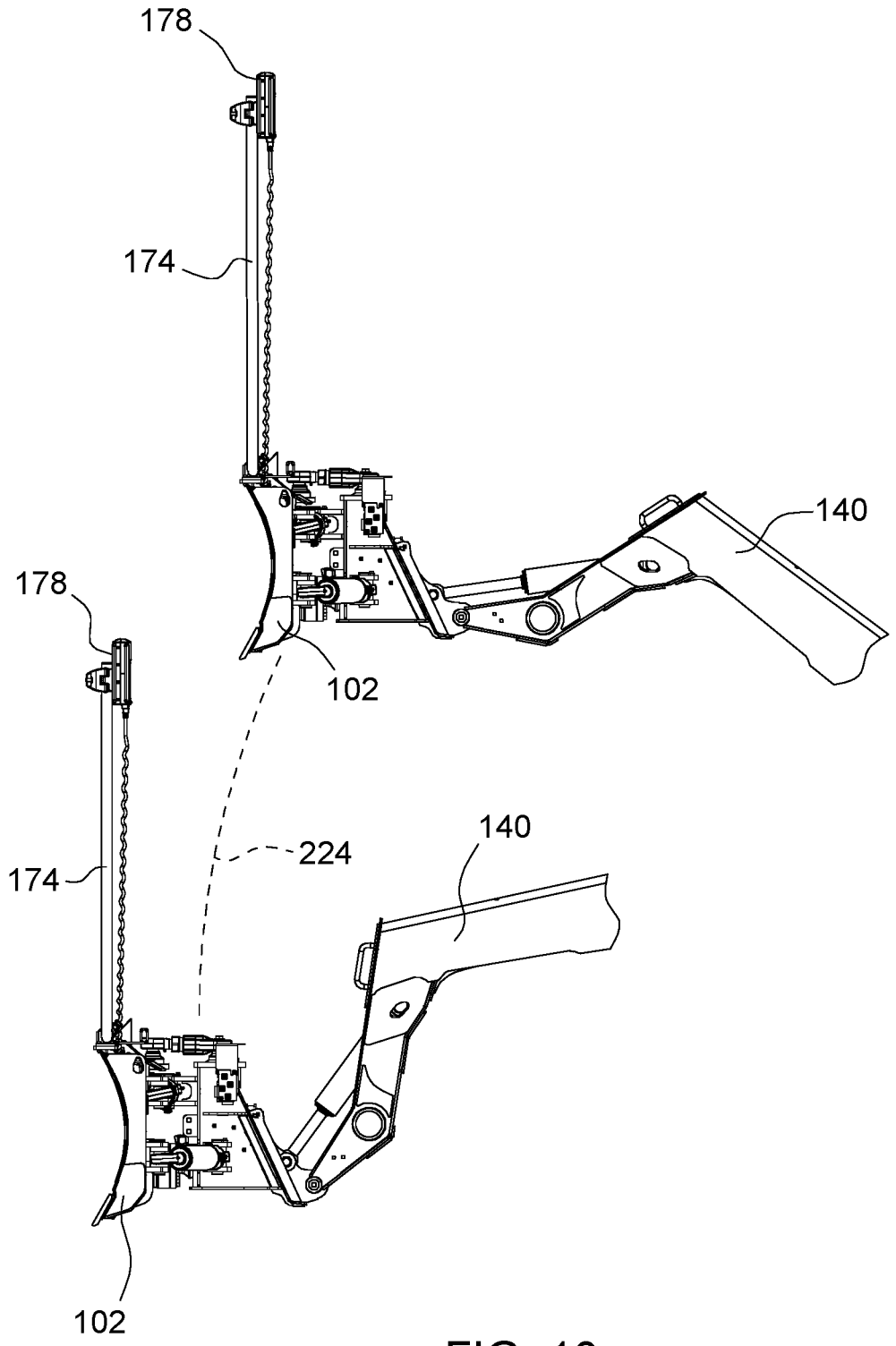
FIG. 10 is a schematic view of the linkage of the work vehicle of the present disclosure wherein the linkage is schematically illustrated translating the dozer blade along the lift path.

Referring now to FIGS. 9 and 10, in the laser receiver automatic find mode, the controller 138 is further configured to maintain the first and second supports 174, 176 in a vertical orientation while determining the first and second difference in height 220, 222 of the dozer blade 102 relative to the vehicle frame 118. Maintaining the first and second supports 174, 176 in the vertical orientation may be accomplished by articulating the linkage 140 which supports and actuates the dozer blade 102 from the vehicle frame 118.

In certain embodiments of the work vehicle 100, such as in the case of a crawler dozer with a 2-way dozer blade only capable of lifting and lowering the dozer blade 102, the linkage 140 may not be capable of maintaining the first and second supports 174, 176 in the vertical orientation. The dozer blade 102 may be lifted along a lift path 224 by the actuation of lift cylinders 144. The lift path 224 is generally curved. Thus, by simply actuating the lift cylinder 144 and translating the dozer blade 102 along the lift path 224, the dozer blade 102 tilts. Thus, the supports 174, 176 are not maintained in a vertical orientation. In embodiments of the work vehicle 100 where this is the case, the controller 138 factors in a vertical error from the first and second supports 174, 176 when determining the first and second differences in height 220, 222. The vertical error is in response to the first and second supports 174, 176 not being in a vertical orientation.

In other embodiments of the work vehicle 100, such as the embodiment schematically illustrated in FIG. 10, the dozer blade 102 may be lifted, tilted, or angled by hydraulic actuation. The dozer blade 102 may be lifted along the lift path 224 by the actuation of lift cylinders 144. As the dozer blade 102 is lifted along the lift path 224, the first and second supports 174, 176 may be maintained in a vertical orientation. This may be accomplished by articulating the linkage 140 wherein as the dozer blade 102 is lifted in the air, the dozer blade 102 is rotated relative to the linkage 140 in the pitch direction 112. However, even in embodiments of the work vehicle 100 such as this, the supports 174, 176 may not achieve a vertical orientation because the dozer blade 102 may be tilted relative to the vehicle frame 118 in the roll direction 110. The dozer blade 102 may be tilted relative to the vehicle frame 118 to grade a cross-slope. Thus, the controller 138 may factor in the vertical error from the first and second supports 174, 176 not being in a vertical orientation.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A work vehicle, comprising:

a vehicle frame;

a plurality of ground engaging units for supporting the vehicle frame from a ground surface;

a ground-engaging dozer blade movably connected to the vehicle frame by a linkage assembly configured to allow the dozer blade to articulate relative to the vehicle frame, the dozer blade including first and second ends;

at least one support having lower and upper portions, the lower portion of the at least one support coupled to the dozer blade;

at least one sensor configured to detect a laser signal plane emitted by a rotating laser, the at least one sensor being mounted to the upper portion of the at least one support; and a controller including a laser receiver automatic find mode configured to:

determine a difference in height of the dozer blade relative to the vehicle frame between a reference position wherein the dozer blade engages the ground surface and a calibration position wherein the at least one sensor is at a desired height relative to the laser signal plane.

2. The work vehicle of claim 1, wherein:

the at least one support includes first and second supports, the lower portion of the first support coupled to the dozer blade nearer to the dozer blade first end than to the dozer blade second end, the lower portion of the second support coupled to the dozer blade nearer to the dozer blade second end than to the dozer blade first end;

the at least one sensor includes first and second sensors, the first sensor being mounted to the upper portion of the first support, the second sensor being mounted to the upper portion of the second support; and in the laser receiver automatic find mode the controller is further configured to:

determine a first difference in height of the dozer blade relative to the vehicle frame between the reference position and a first calibration position wherein the first sensor is at a desired height relative to the laser signal plane; and determine a second difference in height of the dozer blade relative to the vehicle frame between the reference position and a second calibration position wherein the second sensor is at a desired height relative to the laser signal plane.

3. The work vehicle of claim 2, wherein:

in the laser receiver automatic find mode the controller is further configured to raise the dozer blade from the reference position to the first calibration position.

4. The work vehicle of claim 3, wherein:

in the laser receiver automatic find mode the controller is further configured to continue to raise the dozer blade from the first calibration position to the second calibration position.

5. The work vehicle of claim 3, wherein:

in the laser receiver automatic find mode the controller is further configured to lower the dozer blade from the first calibration position to the reference position, and raise the dozer blade from the reference position to the second calibration position.

6. The work vehicle of claim 2, wherein each of the first and second supports include:

an outer support member;

an inner support member received in the outer support member, the inner support member including a gear teeth track extending along a length of the inner support member; and a locking assembly including a gear set engaging the gear teeth track of the inner support member, the locking assembly having a locked configuration wherein translation of the outer support member relative to the inner support member is prevented, and an unlocked configuration wherein the outer support member may translate relative to the inner support member.

7. The work vehicle of claim 6, wherein:

the locking assembly includes a locking gear and is at least partially housed within a case, the case being attached to the outer support member and including a locking gear cutout operable to receive the locking gear therein, the locking gear being configured to engage the locking gear cutout when the locking assembly is in the locked configuration and the locking gear being configured to disengage the locking gear cutout when the locking assembly is in the unlocked configuration.

8. The work vehicle of claim 2, wherein:

the first and second supports each include a sensor configured to measure an extension of an outer support member relative to an inner support member and to generate a signal representative of the extension of the outer support member relative to the inner support member; and the work vehicle further includes a display configured to receive and display the signal representative of the extension of the outer support member relative to the inner support member on the display.

9. The work machine of claim 2, wherein:

each of the first and second supports includes a linear actuator operable to adjust a height of the upper portion of the support, the linear actuators of the first and second supports being adjustable by an operator control input accessible by an operator in an operator cab of the work machine.

10. The work machine of claim 2, wherein:

each of the first and second supports includes a linear actuator operable to adjust a height of the upper portion of the support; and in the laser receiver automatic find mode the controller is further configured to return the dozer blade to the reference position, extend the linear actuator of the first support relative to the dozer blade a distance equal to the first difference in height, and extend the linear actuator of the second support relative to the dozer blade a distance equal to the second difference in height.

11. The work vehicle of claim 1, wherein:

when the dozer blade is in the reference position the dozer blade is oriented at a desired cross-slope relative to the laser signal plane.

12. The work vehicle of claim 1, wherein:

in the laser receiver automatic find mode the controller is further configured to maintain the first and second supports in a vertical orientation.

13. The work vehicle of claim 1, wherein:

in the laser receiver automatic find mode the controller is further configured to display the difference in height on an operator display interface.

14. A method of controlling a work vehicle, the work vehicle including a vehicle frame, a ground-engaging dozer blade having first and second ends and being moveably connected to the vehicle frame by a linkage assembly configured to allow the dozer blade to articulate relative to the vehicle frame, at least one support having upper and lower portions, the lower portion of the at least one support coupled to the dozer blade, at least one sensor configured to detect a laser signal plane emitted by a rotating laser, the at least one sensor being mounted to the upper portion of the at least one support, and a controller, the method comprising:

orienting the work vehicle in an intended grading direction; and automatically determining with the controller a difference in height of the dozer blade relative to the vehicle frame between a reference position wherein the dozer blade engages the ground and a calibration position wherein the at least one sensor is at a desired height relative to the laser signal plane.

15. The method of claim 14, wherein:

the at least one support includes first and second supports, the lower portion of the first support coupled to the dozer blade nearer to the dozer blade first end than to the dozer blade second end, the lower portion of the second support coupled to the dozer blade nearer to the dozer blade second end than to the dozer blade first end;

the at least one sensor includes first and second sensors, the first sensor being mounted to the upper portion of the first support, the second sensor being mounted to the upper portion of the second support; and the method further comprises:

automatically determining with the controller a first difference in height of the dozer blade relative to the vehicle frame between the reference position and a first calibration position wherein the first sensor is at a desired height relative to the laser signal plane; and automatically determining with the controller a second difference in height of the dozer blade relative to the vehicle frame between the reference position and a second calibration position wherein the second sensor is at a desired height relative to the laser signal plane.

16. The method of claim 15, wherein:

in the step of automatically determining the first difference in height, the dozer blade is raised from the reference position to the first calibration position.

17. The method of claim 16, wherein:

in the step of automatically determining the second difference in height, the dozer blade is raised from the first calibration position to the second calibration position.

18. The method of claim 16, wherein:

in the step of automatically determining the second difference in height, the dozer blade is lowered from the first calibration position to the reference position and raised from the reference position to the second calibration position.

19. The method of claim 14, wherein:

when the dozer blade is in the reference position the dozer blade is oriented at a desired cross-slope relative to the laser signal plane.

20. The method of claim 14, further comprising:

positioning the dozer blade in the reference position and extending the at least one support relative to the dozer blade a distance equal to the difference in height.

* * * * *